US009532635B2

(12) United States Patent
Tani

(10) Patent No.: US 9,532,635 B2
(45) Date of Patent: Jan. 3, 2017

(54) APPLYING MATERIAL EXTRUDING CONTAINER

(71) Applicant: TOKIWA CORPORATION, Gifu (JP)

(72) Inventor: Yoshikazu Tani, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 196 days.

(21) Appl. No.: 14/330,418

(22) Filed: Jul. 14, 2014

(65) Prior Publication Data

US 2015/0030371 A1 Jan. 29, 2015

(30) Foreign Application Priority Data

Jul. 29, 2013 (JP) ..... 2013-156453
Feb. 21, 2014 (JP) ..... 2014-031678

(51) Int. Cl.

| | |
|---|---|
| ***A45D 40/04*** | (2006.01) |
| ***A45D 40/12*** | (2006.01) |
| *B43K 21/08* | (2006.01) |
| *B43K 5/06* | (2006.01) |

(52) U.S. Cl.

CPC ..... *A45D 40/04* (2013.01); *A45D 40/12* (2013.01); *B43K 5/06* (2013.01); *B43K 21/08* (2013.01)

(58) Field of Classification Search

CPC combination set(s) only.
See application file for complete search history.

(56) References Cited

U.S. PATENT DOCUMENTS 5,009,534 A * 4/1991 Gueret ..... A45D 40/04 401/175
2016/0000207 A1* 1/2016 Ishida ..... A45D 40/205 401/68

FOREIGN PATENT DOCUMENTS

| | | |
|---|---|---|
| JP | 10-315691 | 12/1998 |
| JP | 2010-104522 | 5/2010 |
| JP | 2012-005526 | 1/2012 |

OTHER PUBLICATIONS

U.S. Appl. No. 14/330,252 to Yoshikazu Tani, filed Jul. 14, 2014.
U.S. Appl. No. 14/330,570 to Yoshikazu Tani, filed Jul. 14, 2014.
Office Action issued in Korea Counterpart Patent Appl. No. 10-2014-0088422, dated Jul. 20, 2016 , along with an English translation thereof.

* cited by examiner

*Primary Examiner* — David Walczak
(74) *Attorney, Agent, or Firm* — Greenblum & Bernstein, P.L.C.

(57) ABSTRACT

An applying material extruding container includes a leading tube and a pipe member inserted into the leading tube so as to be slidable in the axial line direction of the leading tube relative to the leading tube. In the initial state, the front end of the pipe member is located at a position displaced backward a predetermined distance from the front end of the leading tube, and the applying material is filled from in the pipe hole of the pipe member to in the tube hole of the leading tube. The inner surface of the region of the tube hole extends straight in the axial line direction. In the applying material extruding container, when the container main body and the control tube are relatively rotated in one/the other direction, by the screwing action of the first screw part, the pipe member is made to move forward/backward together with the applying material.

4 Claims, 21 Drawing Sheets

APPLYING MATERIAL EXTRUDING CONTAINER

TECHNICAL FIELD

The present invention relates to an applying material extruding container using an applying material in a state of being extruded.

BACKGROUND ART

As a conventional applying material extruding container, the container described in Patent Literature 1 is known. The applying material extruding container described in Patent Literature 1 includes a leading tube forming a tubular shape and having a discharge port (opening) at the tip thereof, and a pipe member inserted into the leading tube so as to be slidable in the axial direction of the leading tube relative to the leading tube and filled with an applying material, wherein the applying material moves forward or moves backward together with the pipe member relative to the leading tube by the relative rotation in one direction or in other direction between the front and rear sections of the container, and the applying material is made to move forward relative to the leading tube and the pipe member by a further relative rotation in one direction between the front and rear sections of the container.

CITATION LIST

Patent Literature

Patent Literature 1: J Japanese Unexamined Patent Application Publication No. 2012-5526

SUMMARY OF THE INVENTION

Problems to be Solved by the Invention

Here, in the tube hole of the leading tube in such an applying material extruding container as described above, an applying material hole is formed in the region from the discharge port at the tip to a position separated toward the rear side from the tip by a predetermined length, a pipe member hole having a diameter larger than the diameter of the applying material hole is formed in the region from the applying material hole toward the rear side, and a pipe member is housed in the pipe member hole as inserted so as to be slidable in the axial line direction. Consequently, a step (step surface) is formed on the inner surface of the tube hole of the leading tube. Accordingly, for example, when the forward and backward movement of the pipe member is repeated, there is a possibility that the shape of the filled applying material is collapsed by the step; in particular, when the applying material is a soft material, the applying material concerned tends to enter the step, and hence such a possibility as described above comes to be remarkable.

Accordingly, the technical problem of the present invention is to provide an applying material extruding container capable of suppressing the collapse of the shape of the applying material.

Solutions to the Problems

In order to solve the above-described problems, the applying material extruding container according to the present invention is an applying material extruding container which is provided with a screw part in the container and uses an applying material in a state of being extruded. The applying material extruding container includes a leading tube forming a tubular shape and having an opening at the tip thereof, a pipe member inserted into the leading tube so as to be slidable in the axial line direction of the leading tube relative to the leading tube, wherein in the initial state, the front end of the pipe member is located at a position displaced backward by a predetermined distance from the front end of the leading tube, and the applying material is filled from in the pipe hole of the pipe member to in the tube hole of the leading tube; at least the inner surface of the region filled with the applying material in the tube hole of the leading tube extends straight in the axial line direction; when the front section of the container and the rear section of the container are relatively rotated in one direction, the pipe member is made to move forward together with the applying material by the screwing action of the screw part, relative to the leading tube, and when further relatively rotated in one direction, the applying material is made to move forward by the screwing action of the screw part, relative to the leading tube and the pipe member; and when the front section of the container and the rear section of the container are relatively rotated in the other direction, the pipe member is made to move backward together with the applying material by the screwing action of the screw part, relative to the leading tube.

In the applying material extruding container, in the initial state, the front end of the pipe member is located at a position displaced backward by a predetermined distance from the front end of the leading tube, the applying material is filled from in the pipe hole of the pipe member to in the tube hole of the leading tube; and the inner surface of the tube hole of the leading tube extends straight in the axial line direction at least in the region in which the applying material is filled. Accordingly, even when the pipe member moves forward or backward, the filled applying material is made to move forward or backward without being collapsed in the shape thereof due to the shape (for example, step) of the inner surface of the tube hole. In other words, according to the present invention, it is possible to suppress the collapse of the shape of the applying material.

The front end of the pipe member is preferably located in a forward limit thereof at approximately the same position as the front end of the leading tube. Usually, at the time of use, on the applying material extruded from the pipe member, a force is exerted in which the front end of the pipe member serves as a supporting point. Accordingly, in order to suppress the collapse of the applying material such as a breakage of the applying material, the front end of the pipe member is preferably located on the front side (the side of the user). On the other hand, when the front end of the pipe member is more projected forward than the front end of the leading tube, the tip of the pipe member tends to be brought into contact with the user, and hence the degradation of the usability is concerned. Regarding this point, in the present invention, it is possible to locate, at the time of use, the front end of the pipe member at the most forward position within a range hardly brought into contact with the user, and consequently, it is possible to further suppress the collapse of the shape of the applying material while the usability is being made higher.

As the constitution to suitably achieve the above-described operation and effect, specifically, here is quoted a constitution in which the screw part includes a first screw part and a second screw part; when the front section of the container and the rear section of the container are relatively rotated in one direction, by the screwing action of the first screw part or the screwing action of the first and second screw parts, the pipe member is made to move forward together with the applying material relative to the leading tube; and when further relatively rotated in one direction, the applying material is made to move forward by the screwing action of the second screw part relative to the leading tube and the pipe member.

Advantageous Effects of the Invention

According to the present invention, it is possible to provide an applying material extruding container capable of suppressing the collapse of the shape of the applying material.

BRIEF DESCRIPTION OF DRAWINGS

FIG. 7(*b*) is a bottom view illustrating the moving screw tube of FIG. 7(*a*);

FIG. 10(*b*) is a cross-sectional view illustrating the piston of FIG. 10(*a*);

DESCRIPTION OF EMBODIMENTS

Hereinafter, the preferred embodiments of the present invention are described in detail with reference to the accompanying drawings. In the following description, the same reference sign is assigned to the same or corresponding elements, and thus the duplicate descriptions are omitted.

Figure 1:
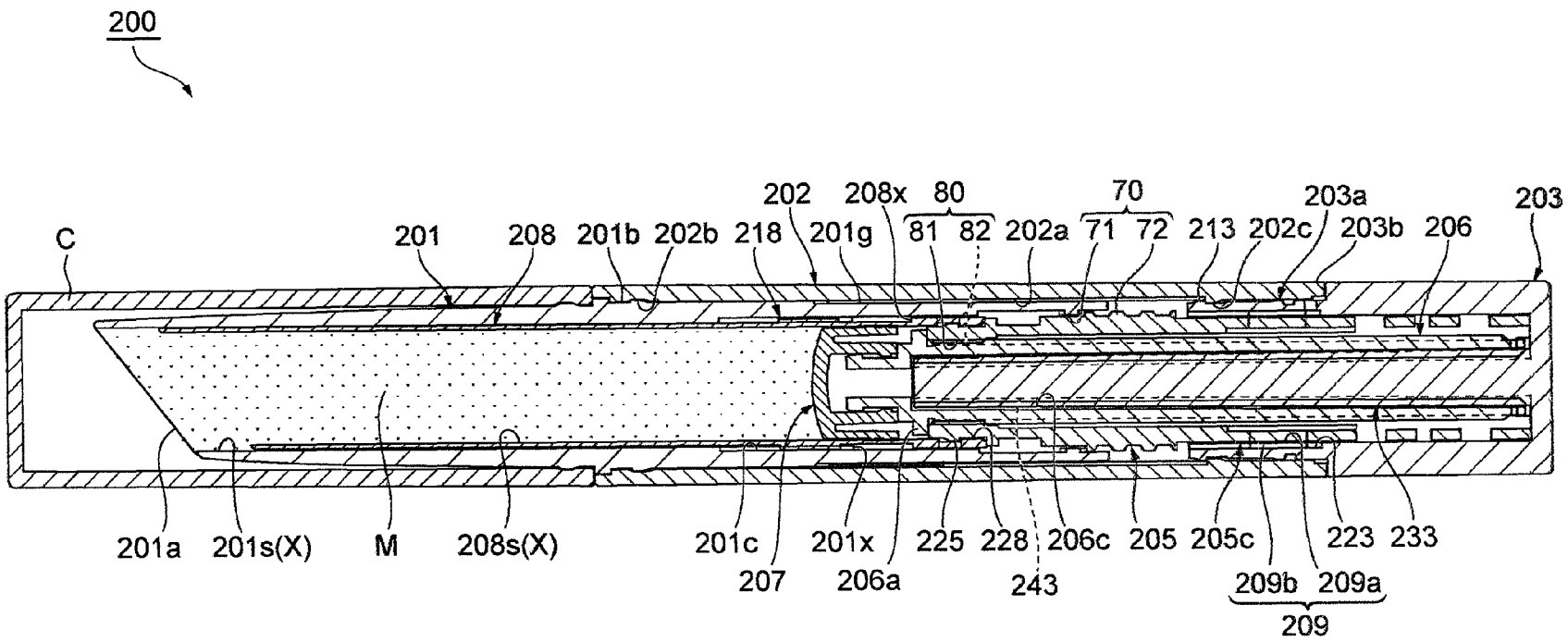
FIG. 1 is a longitudinal cross-sectional view illustrating the initial state of the applying material extruding container according to one embodiment.
Figure 2:
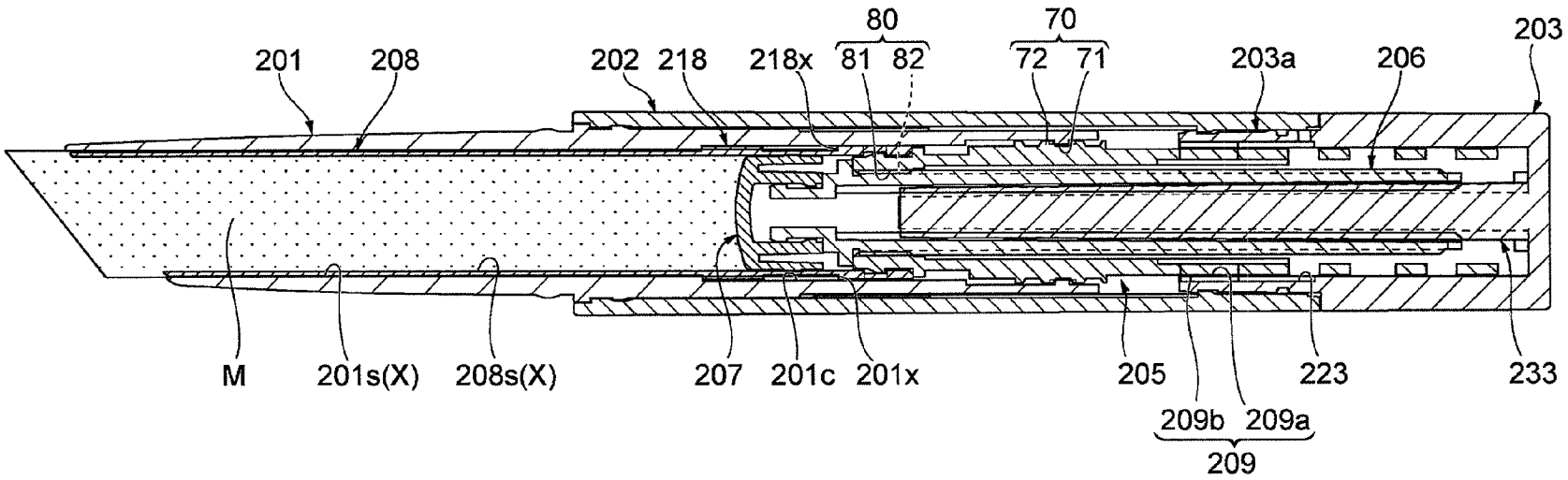
FIG. 2 is a longitudinal cross-sectional view illustrating the state of the forward limit of the pipe member in the applying material extruding container of FIG. 1.
Figure 3:
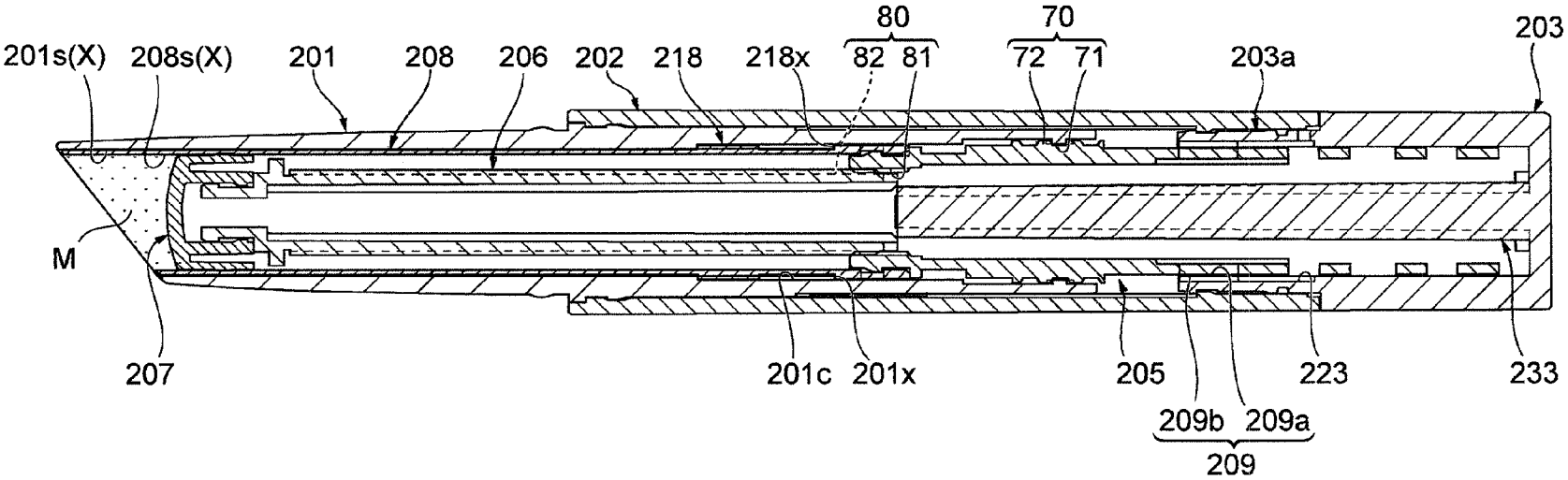
FIG. 3 is a longitudinal cross-sectional view illustrating the state of the forward limit of the piston in the applying material extruding container of FIG. 1.

FIG. 1 is a longitudinal cross-sectional view illustrating the initial state of the applying material extruding container according to one embodiment; FIG. 2 is a longitudinal cross-sectional view illustrating the state of the forward limit of the pipe member in the applying material extruding container of FIG. 1; and FIG. 3 is a longitudinal cross-sectional view illustrating the state of the forward limit of the piston in the applying material extruding container of FIG. 1. As illustrated in FIG. 1, the applying material extruding container 200 of the present embodiment houses the applying material M, and at the same time, is capable of extruding and drawing back the applying material M appropriately by the operation of the user.

As the applying material M, it is possible to use, for example, various rod-like cosmetics including lip stick, lip gloss, eye liner, eye color, eye brow, lip liner, cheek color, concealer, cosmetic stick and hair color, and rod-like cores such as writing implements; in particular, it is preferable to use extremely soft rod-like products (semisolid, soft-solid, soft, jelly-like and mousse-like products, and paste-like products including these). It is also possible to use rod-like products having a small diameter of 1 mm or less and rod-like products having a larger diameter of 10 mm or more.

As the applying material M, it is preferable to use semisolid products having a relatively low hardness; in particular, an applying material having a hardness of about 0.4 N to 0.9 N can be preferably used. The hardness of the applying material M is determined by a common measurement method used for measuring the hardness of cosmetics. Here, for example, the FUDOH RHEO METER, RTC-20020D.D (manufactured by Rheotec Messtechnik GmbH) is used as a measurement apparatus, wherein under an atmospheric condition of a temperature of 25° C., a steel rod (adapter) of ϕ2 mm is inserted into the applying material M to a depth of about 10 mm at a speed of 6 cm/min, and the force (strength) generated in the applying material M at a peak in the course of the insertion operation is taken as the hardness (penetration).

The applying material extruding container 200 is provided as the external constitution thereof with a leading tube 201 being filled in the inside thereof with an applying material M and having a discharge port (opening) 201*a* at the tip thereof, a container main body 202 having the leading tube 201 inserted into the front half thereof and integrally connecting the leading tube 201 so as to engage the leading tube 201 in the axial line direction and the rotation direction around the axial line (hereinafter, simply referred to as the "rotation direction"), and a control tube 203 connected to the rear end portion of the container main body 202 in the axial line direction so as to be relatively rotatable, wherein the front section of the container is constituted with the leading tube 201 and the container main body 202, and the rear section of the container is constituted with the control tube 203.

The "axial line" means the central line extending forward and backward in the applying material extruding container 200, and the "axial line direction" means the front-rear direction in the axial line (hereinafter, this is also the case). Additionally, the letting-out direction of the applying material M is defined as the front direction (forward direction) and the letting-back direction of the applying material M is defined as the rear direction (backward direction).

The applying material extruding container 200 has in the inside thereof a moving screw tube 205, a movable body 206 and a piston 207. The moving screw tube 205 is screwed together with the leading tube 201 through the intermediary of a first screw part 70. The movable body 206 is engaged with the control tube 203 in a synchronously rotatable manner and a movable manner in the axial line direction, and at the same time, is screwed together with the moving screw tube 205 through the intermediary of a second screw part 80. The piston 207 is an extrusion part mounted at the front end (tip) of the movable body 206 and is inserted into the below-described pipe member 208 so as to be in close contact with the pipe member 208 to constitute (form) a rear end of the filling region X.

In the present embodiment, the applying material extruding container 200 is provided with the pipe member 208 inserted into the leading tube 201 so as to be slidable in the axial line direction relative to the leading tube 201 and a ratchet mechanism 209 allowing the relative rotation of the moving screw tube 205 and the control tube 203 to be only in one direction.

In the applying material extruding container 200, when the container main body 202 (or alternatively, the leading tube 201) and the control tube 203 are relatively rotated in one direction, the moving screw tube 205 is made to move forward by the screwing action of the first screw part 70, the pipe member 208 is made to move forward relative to the leading tube 201 together with the movable body 206 and the piston 207; when the container main body 202 (or alternatively, the leading tube 201) and the control tube 203 are further relatively rotated in one direction, the movable body 206 and the piston 207 are made to move forward relative to the leading tube 201 and the pipe member 208 by the screwing action of the second screw part 80. When the container main body 202 and the control tube 203 are relatively rotated in the other direction opposite to the one direction, by the screwing action of the first screw part 70, the moving screw tube 205 is made to move backward and the pipe member 208 is made to move backward relative to the leading tube 201 together with the movable body 206 and the piston 207.

The container main body 202 is formed of, for example, ABS resin (acrylonitrile-butadiene-styrene copolymer synthetic resin) so as to have a cylindrical form. The container main body 202 has a knurling 202*a* on the inner circumferential surface of the central portion in the axial line direction so as to engage the leading tube 201 in the rotation direction, wherein in the knurling 202*a*, a large number of raised and recessed portions are disposed in parallel to each other in the circumferential direction, and the raised and recessed portions extend over a predetermined length in the axial line direction. On the inner circumferential surface of the front end portion of the container main body 202, ring-like raised and recessed portions (raised and recessed portions disposed in the axial line direction) 202*b* to engage the leading tube 201 in the axial line direction are provided. On the inner circumferential surface on the rear section side of the container main body 202, a raised portion 202*c* extending in the circumferential direction along the inner circumferential surface is formed so as to engage the control tube 203 in the axial line direction, on the rear side of the knurling 202*a*.

Figure 4:
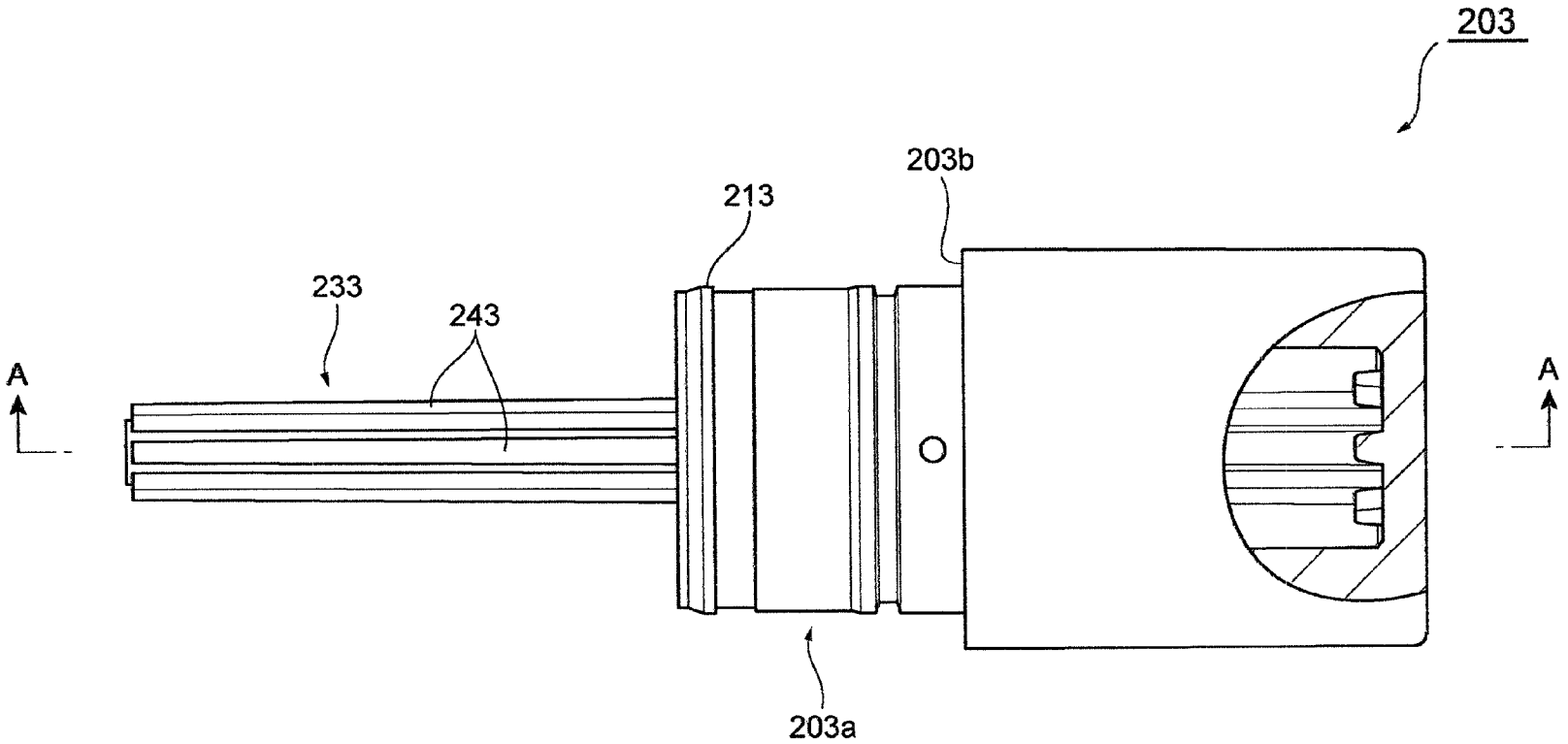
FIG. 4 is a side view of a control tube of the applying material extruding container of FIG. 1 wherein a cross-sectional view of a part of the control tube is shown.
Figure 5:
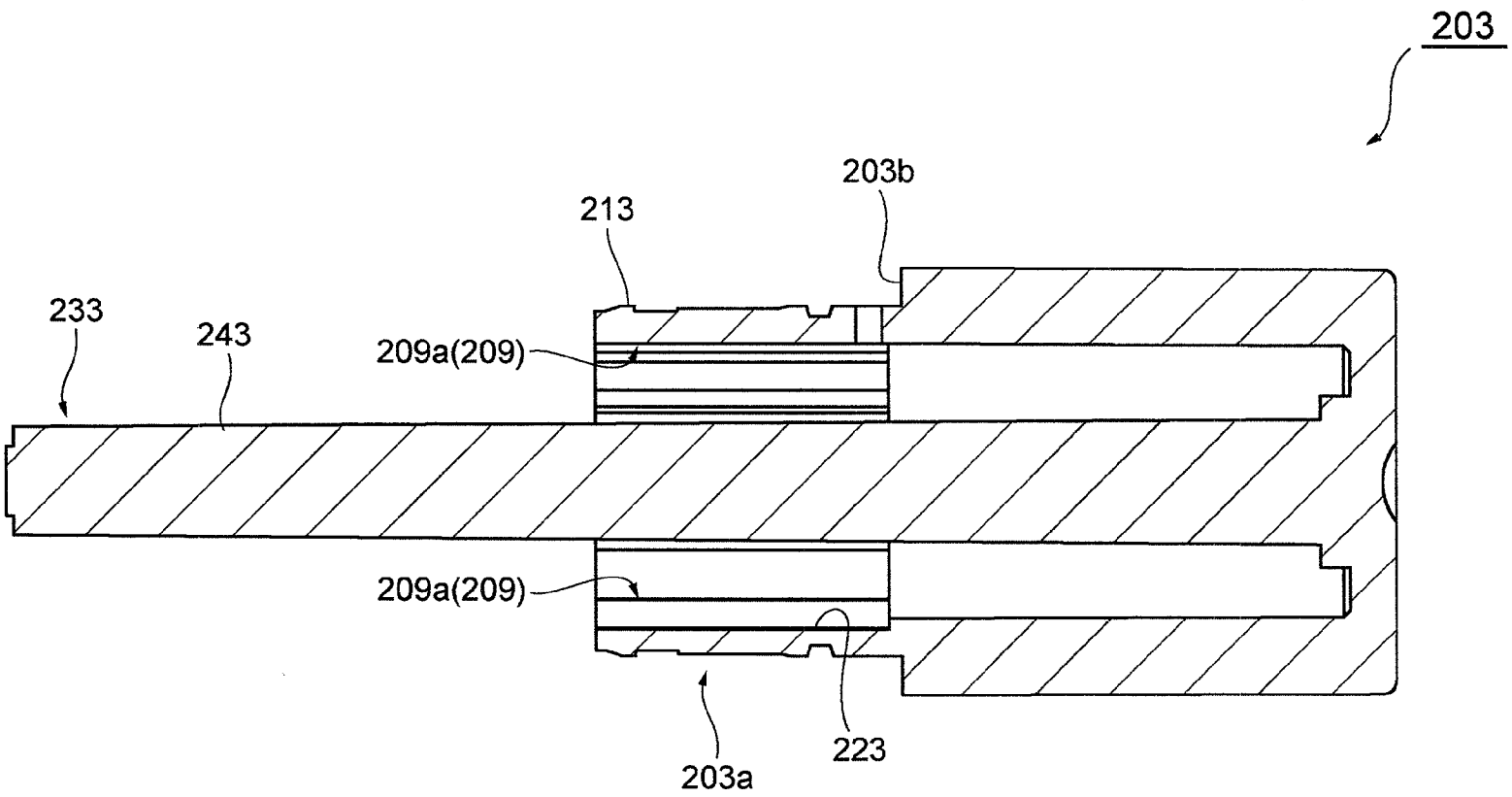
FIG. 5 is a cross-sectional view along the A-A line of FIG. 4.
Figure 6:
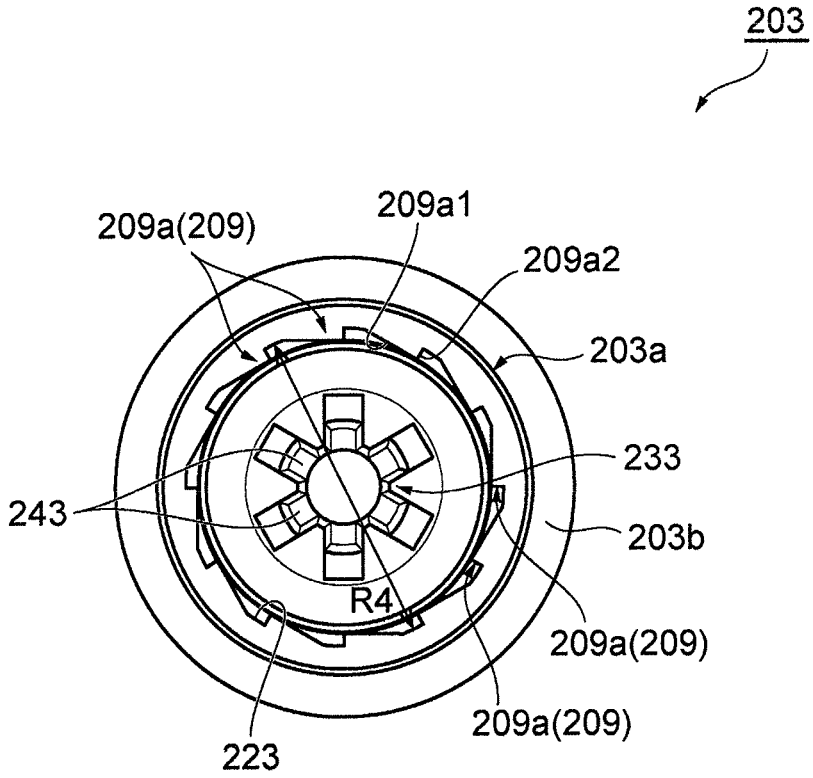
FIG. 6 is a front view illustrating the control tube of FIG. 4.

FIG. 4 is a side view of the control tube of the applying material extruding container of FIG. 1 wherein a cross-sectional view of a part of the control tube is shown; FIG. 5 is a cross-sectional view along the A-A line of FIG. 4; and FIG. 6 is a front view illustrating the control tube of FIG. 4. As illustrated in FIGS. 4 to 6, the control tube 203 is formed of, for example, ABS resin and shows a bottomed cylindrical shape having an opening at the front end. In order to be partially inserted into the container main body 202, the front end side of the control tube 203 has a front end tube portion 203*a* made to have an outer diameter made smaller through the intermediary of a step 203*b*.

In the front section of the outer circumferential surface of the front end tube portion 203*a*, a ring-like raised portion 213 to be engaged in the container main body 202 in the axial line direction is provided. On the inner circumferential surface 223 of the front end tube portion 203*a*, one group of two or more protrusions 209*a* constituting the ratchet teeth of the ratchet mechanism 209 are arranged. The one group of protrusions 209*a* are arranged so as to protrude inward in the radial direction, at twelve equally spaced positions in the circumferential direction on the inner circumferential surface 223 of the front end tube portion 203*a*. Here, the one group of protrusions 209*a* is arranged in the circumferential direction so as to form a sawtooth shape. The one group of protrusions 209*a* are located in a manner extending in the axial line direction so as to always abut to the below-described other group of protrusions 209*b* at the time of forward or backward movement of the moving screw tube 205.

The side surface 209*a*1 on one side (the side abutting to the below-described other group of protrusions 209*b* when the container main body 202 and the control tube 203 are relatively rotated in one direction) in the circumferential direction in the one group of protrusions 209*a* inclines relative to the tangent plane of the inner circumferential surface 223 so as to have a mound-shaped form. The side surface 209*a*2 on the other side (the side abutting to the below-described other group of protrusions 209*b* when the container main body 202 and the control tube 203 are relatively rotated in the other direction) in the circumferential direction in the one group of protrusions 209*a* is constituted so as to be approximately perpendicular to the tangent plane of the inner circumferential surface 223.

In the bottom center of the control tube 203, a shaft 233 to engage in the rotation direction with the movable body 206 is arranged in a standing condition. The shaft 233 has a constitution having a non-circular external shape. Specifically, the shaft 233 has a non-circular transverse cross-sectional shape provided with ridges 243, extending in the axial line direction, arranged on the outer circumferential surface of a cylindrical object, at six equally spaced positions in the circumferential direction so as to protrude outward in the radial direction.

As illustrated in FIGS. 1 and 4, the control tube 203 is mounted to the container main body 202 so as to be relatively rotatable and to be connected in the axial line direction wherein the front end tube portion 203*a* thereof is inserted into the container main body 202, the step 203*b* thereof is pressed against the rear end face of the container main body 202, and at the same time, the ring-like raised portion 213 is engaged in the axial line direction with the raised portion 202*c* of the container main body 202.

Figure 7A:
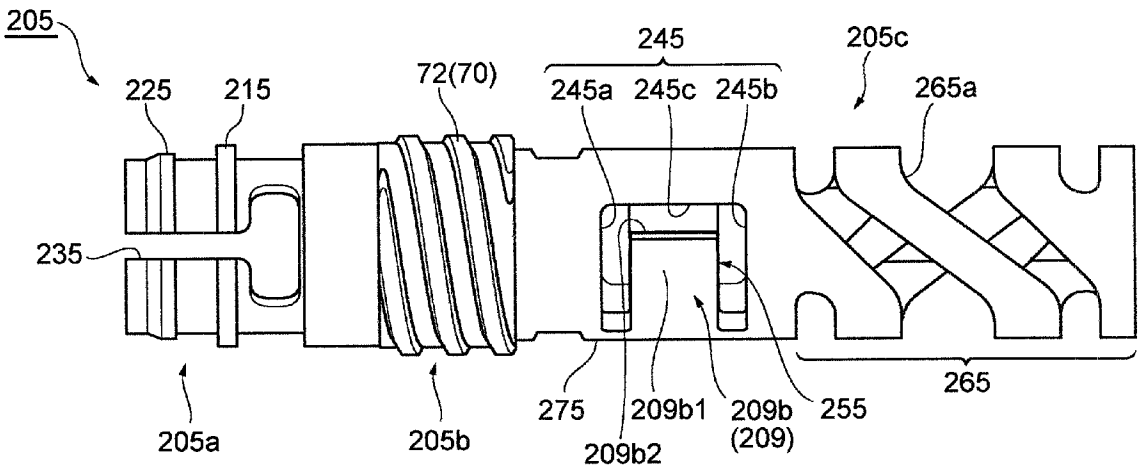
FIG. 7(*a*) is a side view illustrating the moving screw tube of the applying material extruding container of FIG. 1.
Figure 7B:
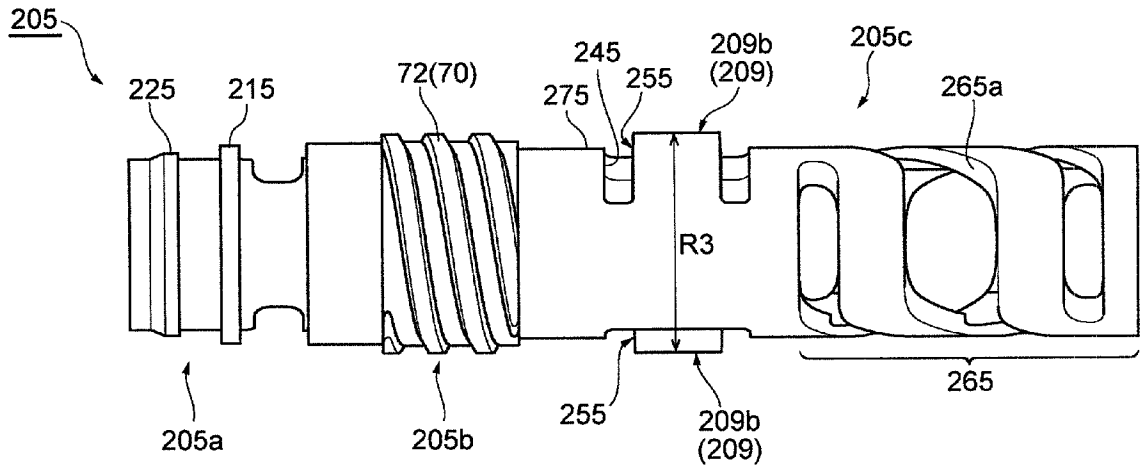
Figure 8:
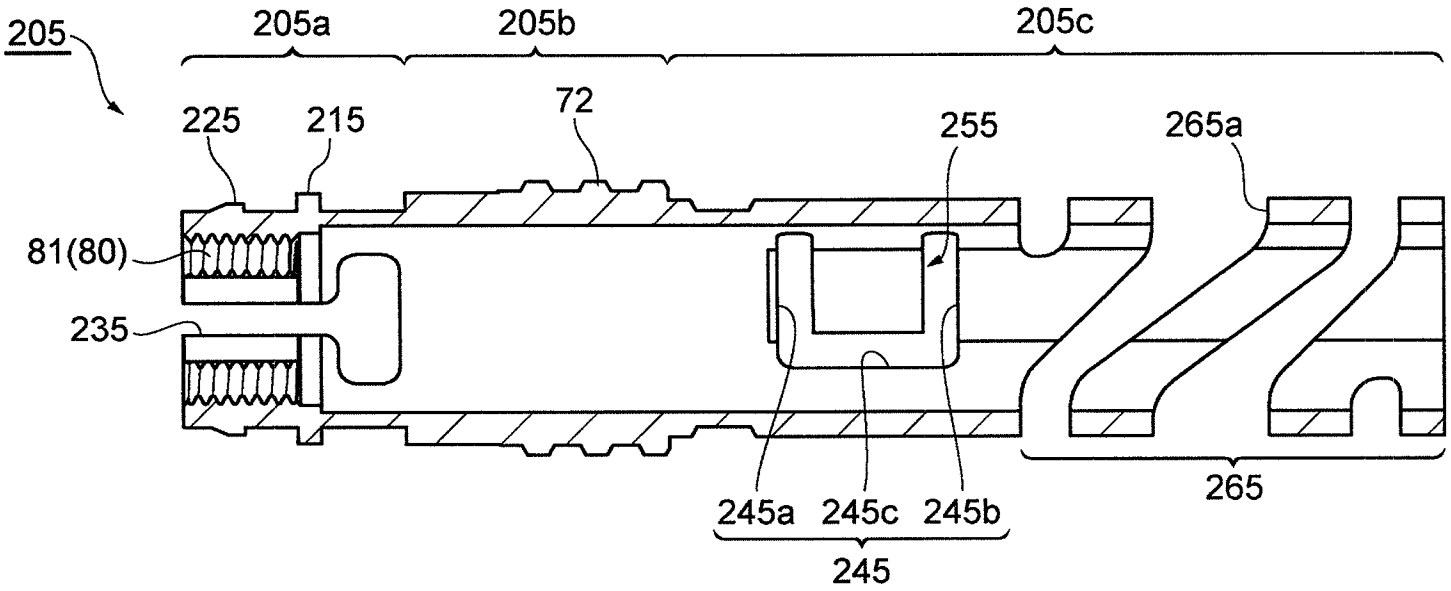
FIG. 8 is a cross-sectional view illustrating the moving screw tube of FIG. 7(*a*)

FIG. 7 is a side view illustrating the moving screw tube of the applying material extruding container of FIG. 1, and FIG. 8 is a cross-sectional view illustrating the moving screw tube of FIG. 7. As illustrated in FIGS. 7 and 8, the moving screw tube 205 is formed of, for example, POM (polyacetal resin) so as to have a cylindrical form. The moving screw tube 205 has an front end portion 205*a* on the front end side, a larger-diameter portion 205*b* connected to the back side of the front end portion 205*a*, and a main body portion 205*c* connected to the back side of the larger-diameter portion 205*b*.

The front end portion 205*a* is provided with a female screw 81 constituting the second screw part 80 on the inner circumferential surface thereof in the region extending from the front end to a position separated from the front end by a predetermined length. The pitch of the second screw part 80 is designed to be finer than the pitch of the first screw part 70, and the lead (the propulsion magnitude per one relative rotation of the container main body 202 and the control tube 203) of the first screw part 70 is set to be larger than the lead of the second screw part 80.

In the central portion of the outer circumferential surface of the front end portion 205*a*, a ring-like flange 215 abutting in the axial line direction to the rear end face of the pipe member 208 is provided. On the front side in the outer circumferential surface of the front end portion 205*a*, a ring-like raised portion 225 engaged in the axial line direction with the pipe member 208 is provided. The front end portion 205*a* is constituted so as to be expandable outward in the radial direction, due to the slits 235 formed so as to face each other and to form a pair, each extending over a predetermined length from the front end in the axial line direction. The rear end sides of the slits 235 are each made wider as viewed laterally (see FIG. 7) so as to form an ellipse with a major axis in the circumferential direction; in order to thus facilitate the release from the mold at the time of molding or the assembling of the movable body 206, the front end portion 205*a* is constituted so as to be easily expandable.

The larger-diameter portion 205*b* has an external shape having a larger diameter than that of the front end portion 205*a*, and is arranged in the moving screw tube 205 so as to be closer to the front in the central portion in the axial line direction. In the larger-diameter portion 205*b*, a male screw 72 constituting the first screw part 70 is provided on the outer circumferential surface thereof, in the region from the rear end to a position separated toward the front side from the rear end by a predetermined length.

The main body portion 205*c* has an external shape having a smaller diameter than that of the larger-diameter portion 205*b*, and is arranged in the region from the central portion to the rear end portion in the axial line direction in the moving screw tube 205. In the main body portion 205*c*, the other group of protrusions 209*b* constituting the ratchet teeth of the ratchet mechanism 209 are arranged at a pair of positions facing each other on the outer circumferential surface 275 thereof. The other group of protrusions 209*b* are engaged in the rotation direction with the one group of protrusions 209*a* (see FIG. 6), and are arranged so as to protrude outward in the radial direction. In the main body portion 205*c*, around the other group of protrusions 209*b*, a notch 245 having a U-shaped cross section, communicating the inside and the outside of the moving screw tube 205 with each other is formed, and the notch 245 allows the other group of protrusions 209*b* to have elasticity in the radial direction.

Specifically, the notch 245 includes: a pair of slits 245*a* and 245*b* being formed by drilling at both sides in the axial line direction of the other group of protrusions 209*b* in the main body portion 205*c* and extending in the circumferential direction; and a slit 245*c* being formed by drilling on one side in the circumferential direction of the other group of protrusions 209*b* and extending in the axial line direction so as to be continued to the slits 245*a* and 245*b*. The wall surrounded by the notch 44 in the main body portion 205*c* forms an arm 255 having flexibility in the radial direction, and thus, the other group of protrusions 209*b* arranged at the tip of the arm 255 is allowed to have a predetermined elastic force (biasing force) in the radial direction.

The side surface 209*b*1 on the other side (the side abuts to the one group of protrusions 209*a* when the container main body 202 and the control tube 203 are relatively rotated in one direction) in the circumferential direction inclines relative to the tangent plane of the outer circumferential surface 275 so as to have a mound-shaped form. The side surface 209*b*2 on the one side (the side abuts to the one group of protrusions 209*a* when the container main body 202 and the control tube 203 are relatively rotated in the other direction) in the circumferential direction in the other group of protrusions 209*b* is constituted so as to be approximately perpendicular to the tangent plane of the outer circumferential surface 275.

A spring part 265 is provided so as to be closer to the rear section than the other group of protrusions 209*b* in the main body portion 205*c*. The spring part 265 is a so-called resin spring designed to be stretchable in the axial line direction, and biases the male screw 72 so as for the first screw part 70 to be restored in screwing. The spring part 265 extends along the outer circumferential surface in a spiral form, and is provided by forming a slit 265*a* communicating the inside and outside with each other in the main body portion 205*c*.

As illustrated in FIGS. 1 and 7, the moving screw tube 205 is inserted into the container main body 202 and the control tube 203, and at the same time, the other group of protrusions 209*b* are engaged in the rotation direction with the one group of protrusions 209*a* of the control tube 203 so as to form the ratchet mechanism 209.

Figure 9:
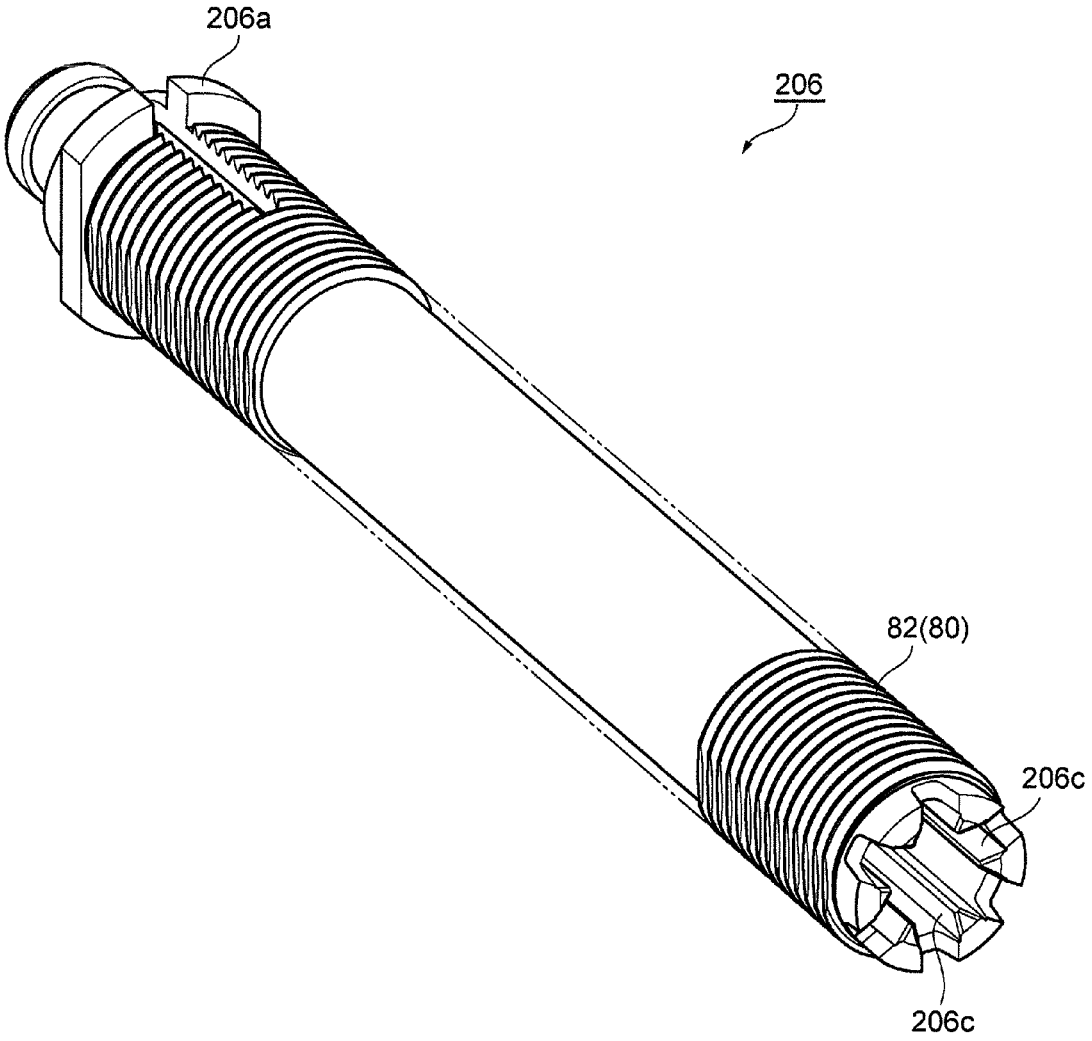
FIG. 9 is an oblique perspective view illustrating a movable body of the applying material extruding container of FIG. 1.

FIG. 9 is an oblique perspective view illustrating the movable body of the applying material extruding container of FIG. 1. As illustrated in FIG. 9, the movable body 206 is formed of, for example, POM, so as to have a cylindrical form provided with a flange 206*a* on the tip side thereof. The movable body 206 is provided with a male screw 82 of the second screw part 80 on the outer circumferential surface in a region ranging from the back side of the flange 206*a* to the rear end portion. On the inner circumferential surface of the movable body 206, ridges 206*c* radially protruding and extending in the axial line direction are arranged at six equally spaced positions in the circumferential direction so as to be engaged with the control tube 203 in the rotation direction.

As illustrated in FIGS. 1 and 9, the movable body 206 is inserted, from the rear end side thereof, between the shaft 233 of the control tube 203 and the moving screw tube 205. In this case, the movable body 206 is mounted to the control tube 203 so as to be synchronously rotatable and movable in the axial line direction wherein the male screw 82 is engaged with the female screw 81 of the moving screw tube 205, and at the same time the ridges 206*c* of the movable body 206 penetrate into between the ridges 243 and 243 of the shaft 233 so as to be engaged in the rotation direction.

Figure 10:
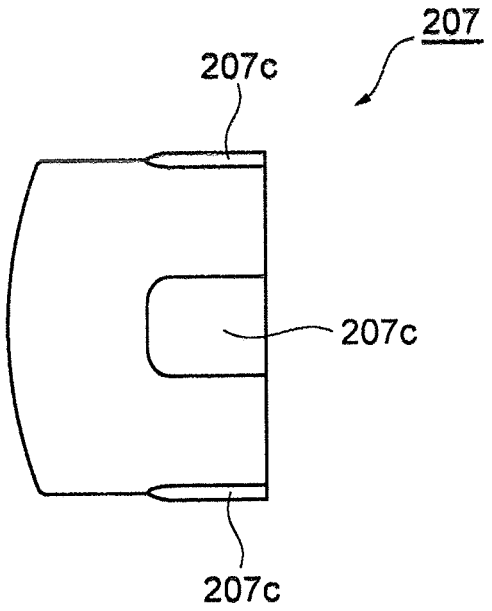
FIG. 10(*a*) is a side view illustrating the piston of the applying material extruding container of FIG. 1.
Figure 10:
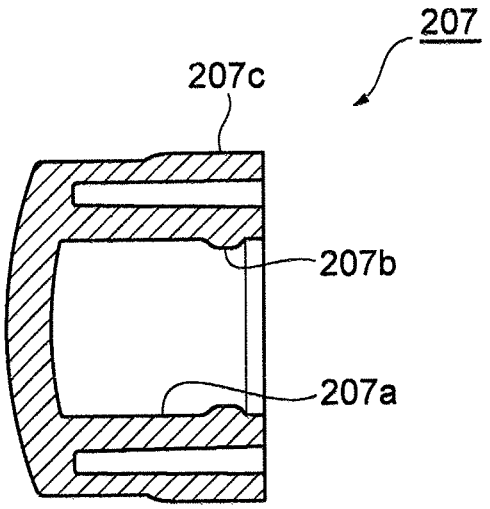

FIG. 10(*a*) is a side view illustrating the piston of the applying material extruding container of FIG. 1, and FIG. 10(*b*) is a cross-sectional view illustrating the piston of FIG. 10(*a*). As illustrated in FIGS. 1 and 10, the piston 207 is formed of, for example, PP (polypropylene), HDPE (high density polyethylene) or LLDPE (linear low density polyethylene). On the inner circumferential surface of the recessed portion 207*a* provided in a recessed condition on the rear end face in the piston 207, there is provided a ring-like protrusion 207*b* engaged with the movable body 206 so as to be movable relative to the movable body 206 in the axial line direction over a predetermined length.

On the outer circumferential surface of the piston 207, raised portions 207*c* are arranged, as the regions in close contact with the pipe member 208, at four equally spaced positions in the circumferential direction. The raised portions 207*c* abut (are brought into close contact with) to the pipe member 208 and are made slidable with resistance, and arranged in an extended manner from the center in the axial line direction to the rear end. By forming a small gap (air trap) between the raised portion 207*c* and the raised portion 207*c* in the circumferential direction and between the raised portions 207*c* and the below-described pipe hole 208*s* of the pipe member 208, it is possible to prevent the spontaneous movement of the applying material M due to the environmental changes such as temperature change. The piston 207 is mounted to the front end of the movable body 206, the ring-like protrusion 207*b* of the piston 207 are engaged in the axial line direction with the movable body 206, and thus the piston 207 is mounted so as to be synchronously rotatable and movable in the axial line direction (movable within a predetermined range) relative to the movable body 206.

Figure 11:
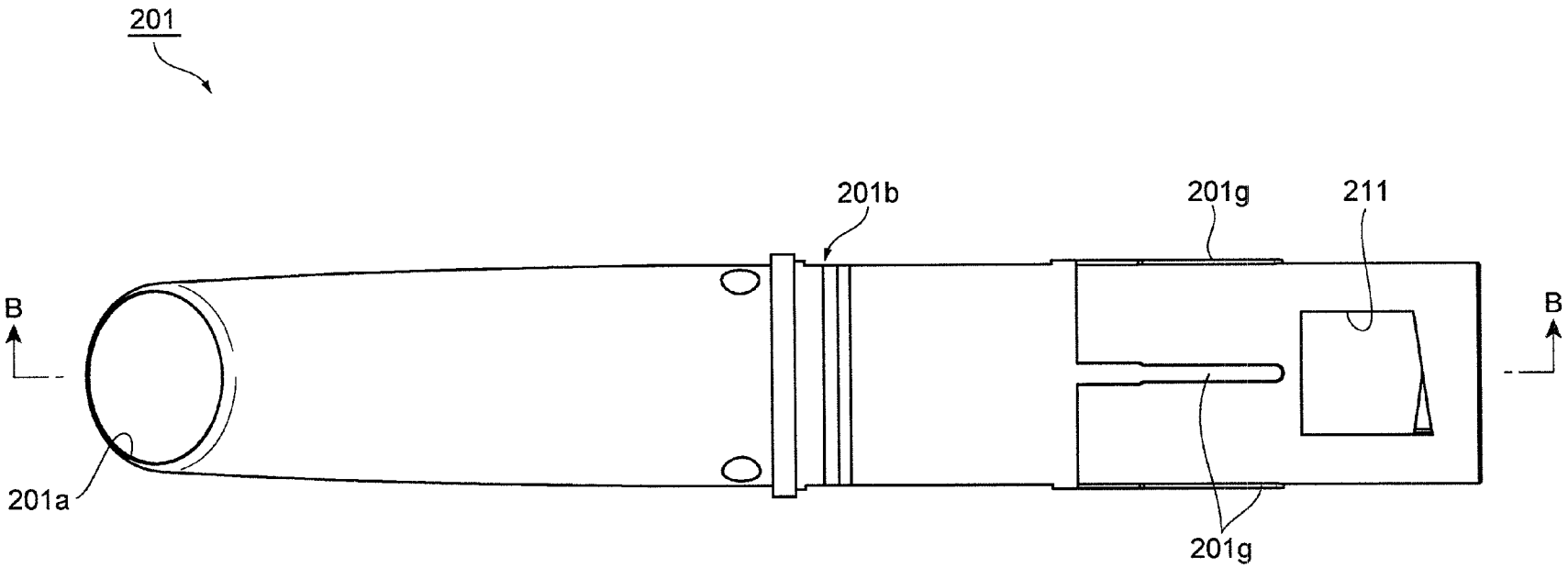
FIG. 11 is a bottom view illustrating the leading tube of the applying material extruding container of FIG. 1.
Figure 12:
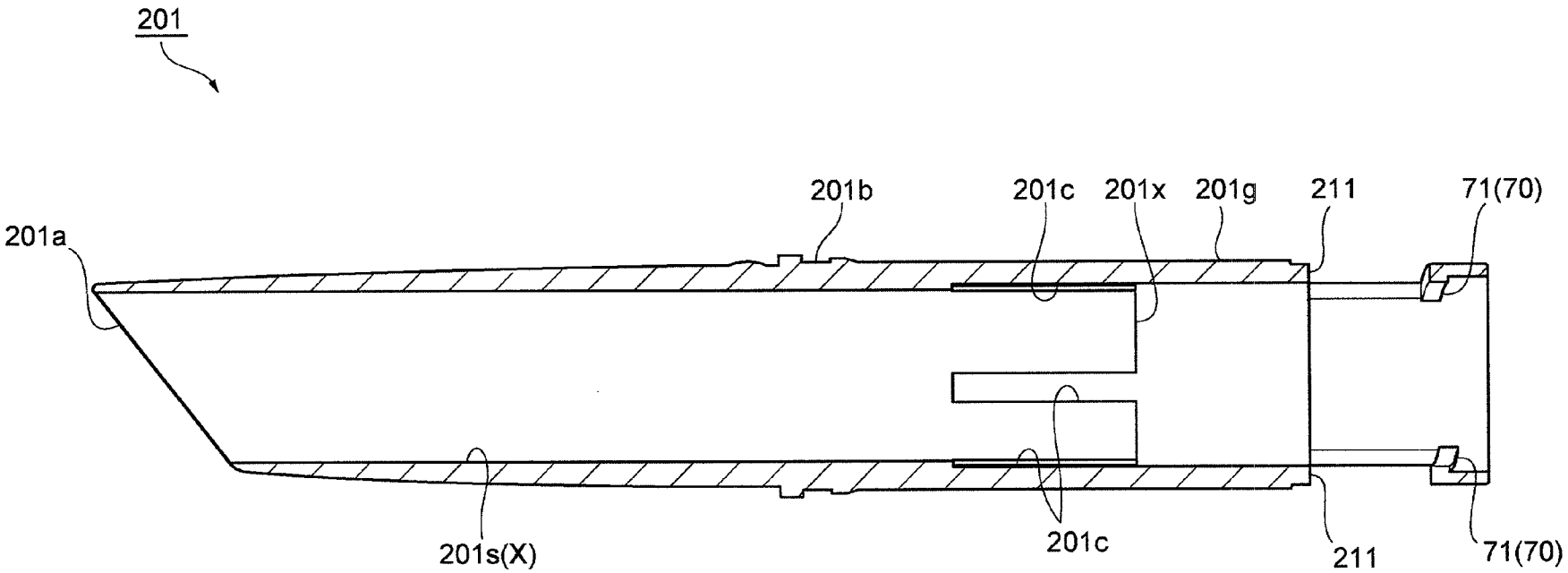
FIG. 12 is a cross-sectional view along the B-B line of FIG. 11.

FIG. 11 is a bottom view illustrating the leading tube of the applying material extruding container of FIG. 1, and FIG. 12 is a cross-sectional view along the B-B line of FIG. 11. As illustrated in FIGS. 11 and 12, the leading tube 201 has a cylindrical form, and the opening at the front end thereof is designed to be the discharge port 201*a* to make the applying material emerge therefrom. The leading tube 201 is formed of, for example, PET (polyethylene terephthalate) resin or ABS resin. The discharge port 201*a* is formed with an inclined plane having a predetermined inclination angle relative to the axial line direction. The discharge port 201*a* may be formed as a flat shape formed with a plane perpendicular to the axial line direction or as a mount shape.

On the outer circumferential surface of the leading tube 201, there are provided ring-like raised and recessed portions 201*b* for being engaged in the axial line direction with the ring-like raised and recessed portions 202*b* of the container main body 202. On the outer circumferential surface of the leading tube 201, at four equally spaced positions in the circumferential direction, closer to the rear end than the ring-like raised and recessed portions 201*b*, ridges 201*g* extending in the axial line direction are provided so as to be engaged in the rotation direction with the knurling 202*a* of the container main body 202.

On the inner circumferential surface of the leading tube 201, two or more grooves 201*c* extending in the axial line direction are provided in the central portion in the axial line so as to be closer to the rear side in a manner of being engaged in the rotation direction with the pipe member 208. The grooves 201*c* are arranged in an extended manner at four equally spaced positions in the circumferential direction on the inner circumferential surface of the leading tube 201. On the inner circumferential surface of the leading tube 201, the region closer to the rear end than the grooves 201*c* is increased in diameter through the intermediary of the step 201*x*, and has an inner diameter continued to the bottom of the grooves 201*c*.

On the outer circumferential surface of the leading tube 201, in the region closer to the rear end than the ridges 201*g*, a pair of openings 211 as the through holes communicating with the inside and the outside of the leading tube 201 are formed so as to face each other. The openings 211 are formed by drilling in substantially rectangular forms as viewed from the facing direction (see FIG. 11); specifically, the openings 211 each include a front edge extending in the circumferential direction, a rear edge extending in the spiral direction relative to the circumferential direction, and both sides extending in the axial line direction.

On the inner circumferential surface of the leading tube 201, on the rear side of the openings 211, the female screw 71 of the first screw part 70 is provided in a connected manner. The female screw 71 is a ridge extending spirally on the inner circumferential surface of the leading tube 201, and is arranged as a pair formed by copying by 180° C. rotation around the axial line on the positions in the circumferential direction of the openings 211. Specifically, the female screw 71 is continued to the openings 211 at the front portion thereof, and is formed in the circumferential direction range from one side to the other side. The spiral direction in which the ridge as the female screw 71 extends corresponds to the above-described spiral direction of the rear edges of the openings 211.

The leading tube 201 having such a female screw 71 can be resin-molded easily and suitably by taking advantage of the openings 211. For example, when an upper mold, a lower mold and a corer pin are assembled with each other, a convex portion on the inner side in the radial direction in the upper mold, the convex portion on the inner side in the radial direction in the lower mold and the core pin allow a pair of predetermined spaces corresponding to the female screw 71 to be demarcated. After molding (namely, after the female screw 71 is formed by filling and solidifying a molten resin in the predetermined spaces), the upper mold is removed outward in the radial direction in such a way that the convex portion of the upper mold is pulled out from one opening 211, and at the same time, the lower mold is removed outward in the radial direction in such a way that the convex portion of the lower mold is pulled out from the other opening 211, and subsequently, the core pin can be pulled out by sliding the core pin straight in the axial line direction.

As illustrated in FIGS. 1 and 12, the container main body 202 is inserted from the rear side of the leading tube 201, the ring-like raised and recessed portions 202*b* of the container main body 202 are engaged in the axial line direction with the raised and recessed portions 201*b* of the leading tube 201, and at the same time, the knurling 202*a* of the leading tube 201 is engaged in the rotation direction with the ridges 201*g*; accordingly, the leading tube 201 is mounted in the container main body 202 so as to be engaged in the axial line direction and in the rotation direction with the container main body 202; thus the leading tube 201 is integrated with the container main body 202. The moving screw tube 205 is mounted to the leading tube 201 from the rear side of the leading tube 201, the female screw 71 of the leading tube 201 is engaged with the male screw 72 of the moving screw tube 205.

Figure 13:
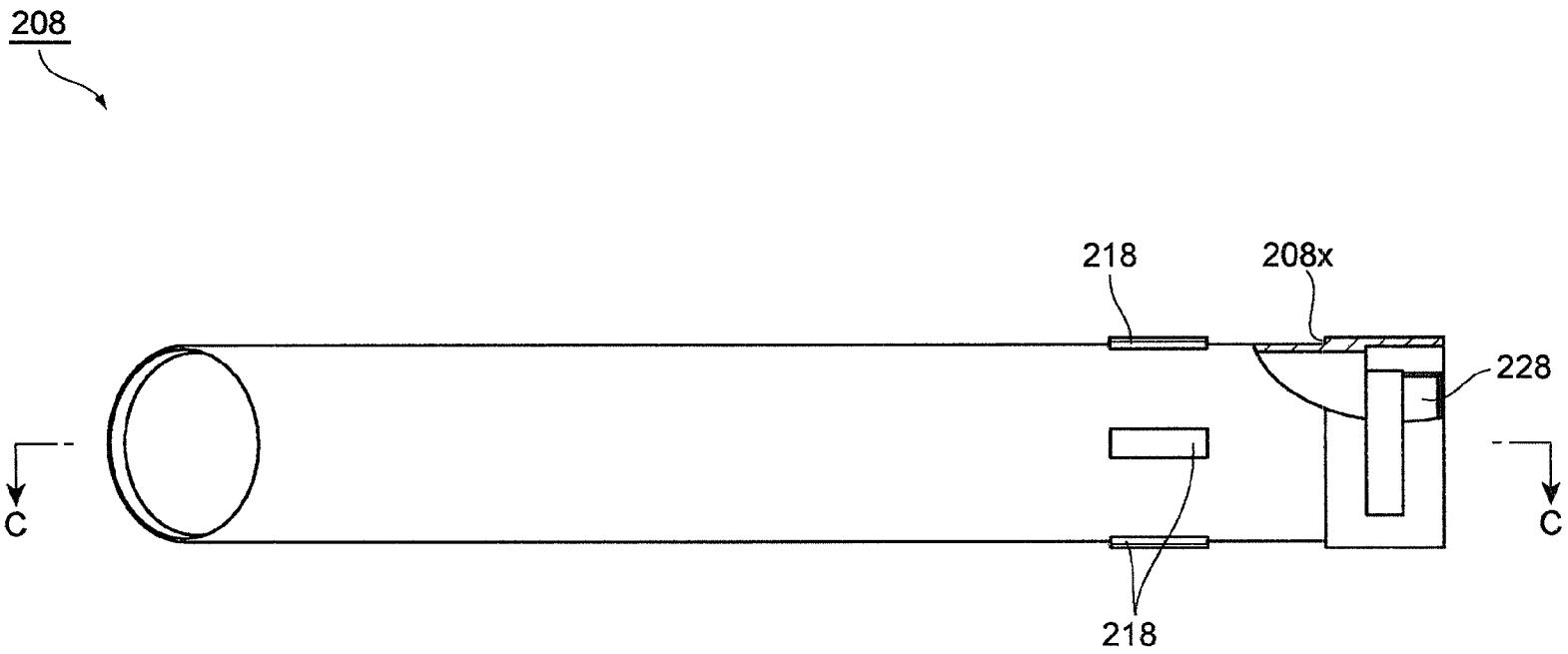
FIG. 13 is a bottom view of the pipe member of the applying material extruding container of FIG. 1 wherein a cross-sectional view of a part of the pipe member is shown.
Figure 14:
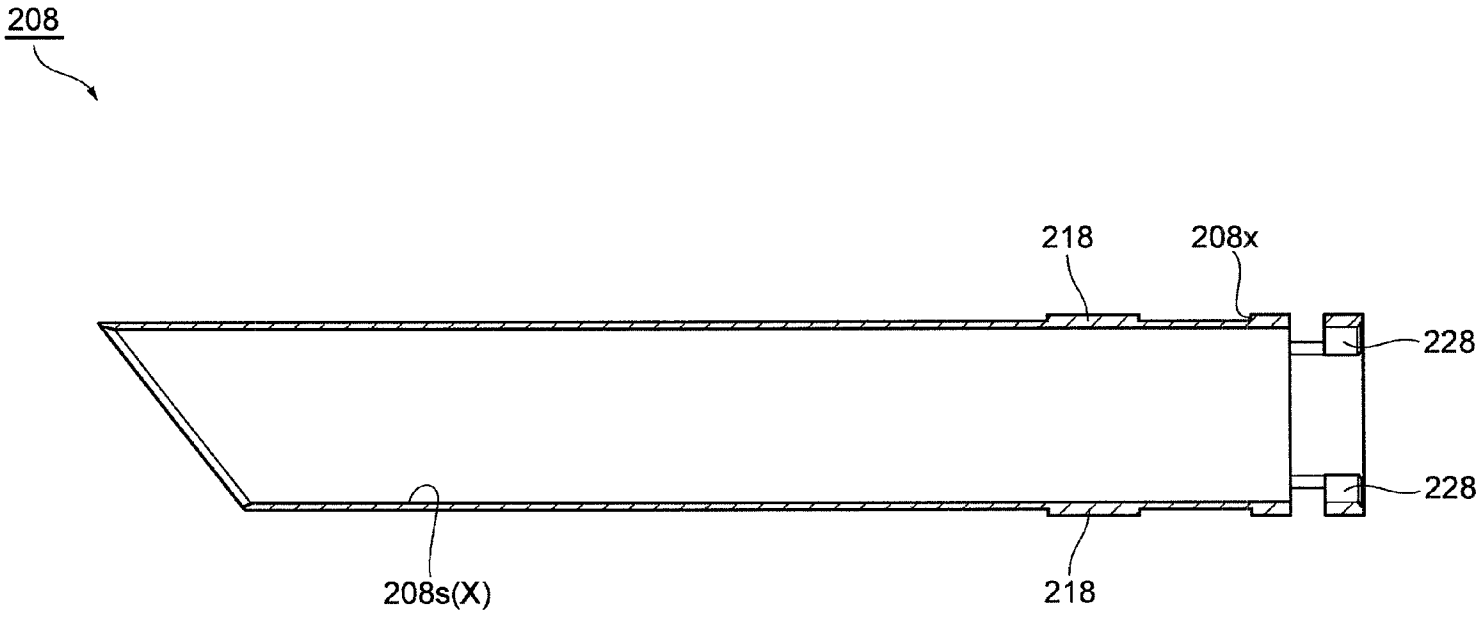
FIG. 14 is a cross-sectional view along the C-C line of FIG. 13.

FIG. 13 is a bottom view of the pipe member of the applying material extruding container of FIG. 1 wherein a cross-sectional view of a part of the pipe member is shown; and FIG. 14 is a cross-sectional view along the C-C line of FIG. 13. As illustrated in FIGS. 13 and 14, the pipe member 208 is formed in a cylindrical shape and has an opening in the front end formed with an inclined plane having the above-described predetermined inclination angle relative to the axial line direction, in the same manner as in discharge port 201*a* (see FIG. 1). The pipe member 208 is formed of, for example, PP. The thickness of the wall forming the pipe hole 208*s* of the pipe member 208 is preferably constant and is preferably made as small as possible; for example, the pipe member 208 is formed with a thickness of 0.2 to 0.5 mm.

On the rear side of the central portion in the axial line direction on the outer circumferential surface of the pipe member 208, two or more ridges 218 extending in the axial line direction are provided so as to be engaged in the rotation direction with the leading tube 201. The ridges 218 are arranged at four unequally spaced positions in the circumferential direction (here, two positions of four equally spaced positions are displaced in the circumferential direction) in order to facilitate the positioning in the circumferential direction at the time of assembling. The rear end portion on the outer circumferential surface of the pipe member 208 is increased in diameter through the intermediary of a step 208*x*. The rear end portion on the inner circumferential surface of the pipe member 208 is provided with a pair of protrusions 228 protruding inward in the radial direction so as to face each other and so as to be engaged in the axial line direction with the moving screw tube 205.

As illustrated in FIGS. 1 and 14, the pipe member 208 is inserted into the leading tube 201, and is made to be slidable in the axial line direction relative to the leading tube 201. In this case, the grooves 201*c* of the leading tube 201 are engaged in the rotation direction with the ridges 218, and thus, the relative rotation of the pipe member 208 relative to the leading tube 201 is regulated. In the adopted constitution, in the initial state the front end of the pipe member 208 is located at a position displaced backward by a predetermined distance from the front end of the leading tube 201, and is positioned in the forward limit at the position approximately the same as the position of the front end of the leading tube 201 (see FIG. 2).

The pipe member 208 is mounted to the front side of the moving screw tube 205, the rear end face of the pipe member 208 is pressed against the flange 206*a* of the moving screw tube 205, and at the same time, the protrusions 228 of the pipe member 208 are engaged with the ring-like raised portion 225 of the moving screw tube 205, and thus the pipe member 208 is connected in the axial line direction to the moving screw tube 205. The piston 207 is inserted into the pipe member 208 in sliding contact therewith.

In the present embodiment, the applying material M is filled in the initial state so as to be filled in the pipe hole 208*s* of the pipe member 208 to in the tube hole 201*s* of the leading tube 201 (filled without leaving any space); specifically, the filled region X in which the applying material M is filled is constituted with the inner circumferential surface of the leading tube 201, the inner circumferential surface of the pipe member 208 and the front face of the piston 207.

In the tube hole 201*s* of the leading tube 201, at least the inner circumferential surface to be the inner surface of the region in which the applying material M is filled extends straight in the axial line direction. Specifically, in the inner circumferential surface constituting the tube hole 201*s*, the front side region from the front end position of the pipe member 208 in the backward limit (the initial state) of the pipe member 208 does not have any steps, angular portions, recessed portions, depressions and the like (hereinafter, simply referred to as "steps and the like"), and the inner circumferential surface constituting the tube hole 201*s* is not inclined relative to the axial line direction and extends parallel and straight in the axial line direction. Here, in the region in which the applying material M is filled, the tube hole 201*s* is designed to have a constant circular cross section as viewed in the axial line direction, and at the same time, is designed so as for both edges to be parallel as viewed from the side.

In the present embodiment, as illustrated in FIGS. 6 and 7, in the state before the front end tube portion 203*a* of the control tube 203 is mounted to the main body portion 205*c* of the moving screw tube 205 (in the state before assembly), the outer diameter R3 of the front end portion in the other group of protrusions 209*b* of the main body portion 205*c* is larger than the inner diameter R4 of the inner circumferential surface 223 of the front end tube portion 203*a*. For example, the outer diameter R3 is made to be larger by a predetermined length than the inner diameter R4; specifically, the outer diameter R3 is set at ϕ9.4 mm and the inner diameter R4 is set at ϕ9.0 mm. As illustrated in FIGS. 1 to 3, in the state in which the front end tube portion 203*a* is inserted into the main body portion 205*c* (the state after assembly), the other group of protrusions 209*b* are made to always abut to the inner circumferential surface 223 of the front end tube portion 203*a*.

Next, an example of the operation of the applying material extruding container 200 is described.

For example, in the applying material extruding container 200 in the initial state, illustrated in FIG. 1, the front end of the pipe member 208 is located at a position displaced backward by a predetermined distance from the front end of the leading tube 201; in this state, the applying material M is filled in close contact with the pipe hole 208*s* of the pipe member 208, the tube hole 201*s* of the leading tube 201 and the piston 207. The front face of the ridges 218 and the step 208*x* of the pipe member 208 are located backward away from the front face of the grooves 201*c* and the step 201*x* of the leading tube 201, and the pipe member 208 is made movable forward by a predetermined distance relative to the leading tube 201.

In the applying material extruding container 200 in this initial state, when the user detaches the cap C, and the container main body 202 and the control tube 203 are relatively rotated in one direction, which is the letting-out direction, the side surface 209*b*1 of the other group of protrusions 209*b* (see FIG. 7) of the moving screw tube 205 is made to abut to the side surface 209*a*1 of the one group of protrusions 209*a* (see FIG. 6) of the control tube 203, and these groups of protrusions are engaged in the rotation direction with each other to allow the control tube 203 and the moving screw tube 205 to be synchronously rotated. In this way, the moving screw tube 205 and the leading tube 201 are relatively rotated, the screwing action of the first screw part 70 constituted with the male screw 72 of the moving screw tube 205 and the female screw 71 of the leading tube 201 operates to allow the moving screw tube 205 to move forward relative to the leading tube 201.

Consequently, the above-described forward movement of the moving screw tube 205 causes the pipe member 208 to move forward together with the movable body 206 and the piston 207 relative to the leading tube 201, the applying material M is let out relative to the leading tube 201 (in other words, the pipe member 208 is made to move forward together with the applying material M relative to the leading tube 201) and the applying material M emerges from the discharge port 201*a*.

Successively, as illustrated in FIG. 2, the relative rotation in one direction is made to continue, and when the front end of the pipe member 208 is positioned at the position approximately the same as the front end of the leading tube 201, the front face of the ridges 218 and the step 208*x* of the pipe member 208 abut to the front face of the grooves 201*c* and the step 201*x* of the leading tube 201, the forward movement of the pipe member 208 and the moving screw tube 205 is stopped, the screwing action of the first screw part 70 is stopped, and thus, the pipe member 208 and the moving screw tube 205 reach the forward limit.

When the relative rotation in the one direction is further continued, a rotational force larger than before the above-described stopping is exerted on the control tube 203 and the moving screw tube 205, the other group of protrusions 209*b* overleap the one group of protrusions 209*a* in a manner running up and sliding, and the control tube 203 and the moving screw tube 205 are made to undergo ratchet rotation (idle rotation). Consequently, only the screwing action of the second screw part 80 constituted with the male screw 82 of the movable body 206 and the female screw 81 of the moving screw tube 205 is exerted, and in the stopped pipe member 208, the applying material M is extruded by the piston 207 to move forward (in other words, the applying material M moves forward relative to the leading tube 201 and the pipe member 208). Subsequently, the movable body 206 and the piston 207 reach the forward limit (see FIG. 3).

On the other hand, in the applying material extruding container 200 after use, when the container main body 202 and the control tube 203 are relatively rotated in the other direction, which is the letting-back direction, the side surface 209*b*2 of the other group of protrusions 209*b* of the moving screw tube 205 (see FIG. 7) abuts to the side surface 209*a*2 of the one group of protrusions 209*a* of the control tube 203 (see FIG. 6) to be latched in the rotation direction (to be firmly engaged), and the control tube 203 and the moving screw tube 205 are synchronously rotated. Thus, the moving screw tube 205 and the leading tube 201 are relatively rotated, the screwing action of the first screw part 70 operates, and the moving screw tube 205 moves backward relative to the leading tube 201.

Consequently, the above-described backward movement of the moving screw tube 205 causes the pipe member 208 to move backward together with the movable body 206 and the piston 207 relative to the leading tube 201, the applying material M is let back to the leading tube 201 (in other words, the pipe member 208 is made to move backward together with the applying material M relative to the leading tube 201) and the applying material M submerges in the discharge port 201*a*.

When the relative rotation in the other direction is continued, the male screw 72 of the moving screw tube 205 is disengaged from the female screw 71 of the leading tube 201, the screwing action of the first screw part 70 is lifted, and the moving screw tube 205, and also the pipe member 208, the movable body 206 and piston 207 reach the backward limit. In this state, the elastic force due to the contraction of the spring part 265 (see FIG. 7) biases the male screw 72 in the forward side; and hence when the relative rotation in the other direction is further continued, click due to the engagement and disengagement of the female screw 71 and the male screw 72 is imparted, the backward movement of the moving screw tube 205 is sensed by the user, and at the same time, when the relative rotation in the one direction is caused, the first screw part 70 instantaneously undergoes restoration of screwing.

In the applying material extruding container 200 of the present embodiment, as described above, the applying material M is filled in the pipe hole 208*s* of the pipe member 208 to in the tube hole 201*s* of the leading tube 201, and the inner circumferential surface of the tube hole 201*s* of the leading tube 201 extends straight in the axial line direction at least in the region in which the applying material M is filled.

Accordingly, when the pipe member 208 moves forward relative to the leading tube 201, the filled applying material M is not collapsed due to the shape of the inner circumferential surface of the tube hole 201*s*; for example, when the steps and the like are formed on the inner circumferential surface, the collapse of the applying material M due to the penetration thereof into or withdrawal thereof from the steps and the like can be prevented. Even in the case where the emerged applying material M is expanded, it is also possible to prevent the collapse of the applying material M due to the penetration thereof into or withdrawal thereof from the steps and the like at the time of the backward movement of the pipe member 208 relative to the leading tube 201.

Therefore, according to the present embodiment, it is possible to prevent the collapse of the shape of the applying material M at the time of forward and backward movement of the pipe member 208 relative to the leading tube 201. In other words, even for a soft applying material M, extrusion and drawing back of a certain amount of the applying material M can be performed certainly and the applying material M can be protected.

Usually, at the time of use, on the applying material M extruded from the pipe member 208, a force or bending is exerted in which the front end of the pipe member 208 serves as a supporting point. Accordingly, in order to suppress the collapse of the applying material M such as a breakage of the applying material M, the front end of the pipe member 208 is preferably located on the front side (the side of the user). On the other hand, when the front end of the pipe member 208 is more projected forward than the front end of the leading tube 201, the tip of the pipe member 208 tends to be brought into contact with the user, and hence the degradation of the usability is concerned.

On the contrary, in the present embodiment, as described above, the front end of the pipe member 208 is located, at the forward limit thereof, at the approximately same position as the front end of the leading tube 201. Accordingly, it is possible to locate the front end of the pipe member 208 at the most forward position within a range hardly brought into contact with the user, and consequently, it is possible to further suppress the collapse of the shape of the applying material M while the usability is being made higher.

As described above, in the state before the front end tube portion 203*a* of the control tube 203 is mounted to the main body portion 205*c* of the moving screw tube 205, the outer diameter R3 of the front end portion in the other group of protrusions 209*b* of the main body portion 205*c* is larger than the inner diameter R4 of the inner circumferential surface 223 of the front end tube portion 203*a* (see FIGS. 6 and 7). In the state that the front end tube portion 203*a* is inserted into the main body portion 205*c*, always while the moving screw tube 205 is moving forward and backward, the other group of protrusions 209*b* having elastic force in the radial direction are always made to abut to the inner circumferential surface 223 of the front end tube portion 203*a* in such a way that the other group of protrusions 209*b* are engaged in the rotation direction with the one group of protrusions 209*a*.

Accordingly, without increasing the number of parts, in such a way that the main body portion 205*c* (the moving screw tube 205) is held by the front end tube portion 203*a* (the control tube 203), it is possible to always generate resistance in the rotation direction between the front end tube portion 203*a* and the main body portion 205*c*, and consequently it is possible to suppress the rattling of the applying material extruding container 200.

In the present embodiment, as described above, when the container main body 202 and the control tube 203 are further rotated in one direction, the other group of protrusions 209*b* are biased in the radial direction by the elastic force in the radial direction due to the notch 245, and hence the side surface 209*b*1 of the other group of protrusions 209*b* are engaged with the side surface 209*a*1 in the rotation direction to slide in a manner running up and overleap the side surface 209*a*1 to lift the engagement, and then the side surface 209*b*1 and the side surface 209*a*1 are again engaged with each other in the rotation direction. Consequently, every time one group of protrusions 209*a* and the other group of protrusions 209*b* are engaged with each other and the engagement is lifted, a click feeling can be imparted to the user. Thus, it is possible to use the one group of protrusions 209*a* and the other group of protrusions 209*b* as a click mechanism to sense further forward movement of the applying material M.

Additionally, in the present embodiment, as described above, it is possible to use the one group of protrusions 209*a* and the other group of protrusions 209*b* as a ratchet mechanism 209 to allow only the relative rotation, in one direction, of the container main body 202 and the control tube 203.

Incidentally, in the present embodiment, as described above, the notch 245 is formed around the other group of protrusions 209*b* of the main body portion 205*c* and elastic force is imparted to the other group of protrusions 209*b*; however, instead of this or in addition to this, a notch may be formed around the one group of protrusions 209*a* of the front end tube portion 203*a* so as to impart elastic force to the one group of protrusions 209*a*.

In the present embodiment, the one group of protrusions 209*a* may be always made to abut to the outer circumferential surface 275 in the state in which in the state before the front end tube portion 203*a* is mounted to the main body portion 205*c*, in the state in which the inner diameter of the tip of the one group of protrusions 209*a* has a smaller diameter than the outer diameter of the outer circumferential surface 275 of the main body portion 205*c*, and the front end tube portion 203*a* is mounted to the main body portion 205*c*.

Figure 15:
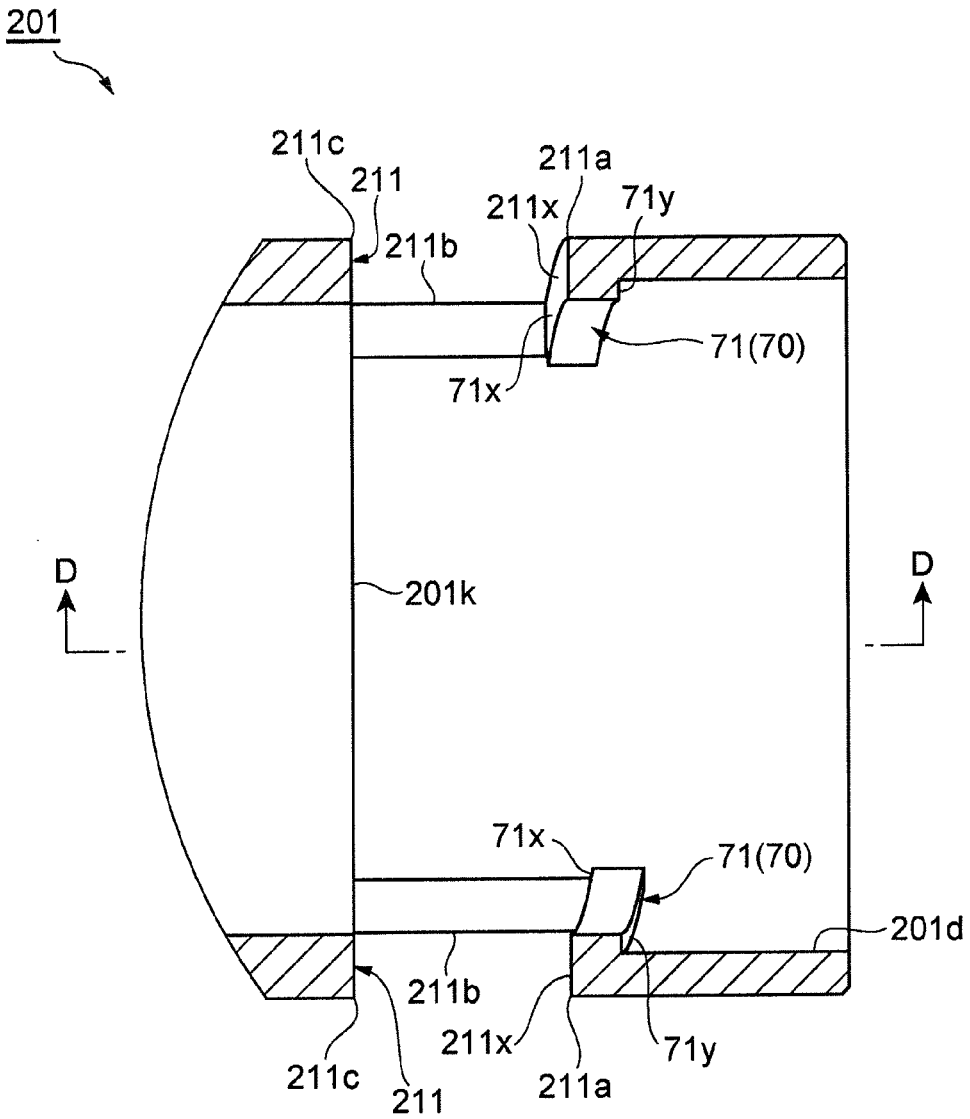
FIG. 15 is an enlarged cross-sectional view illustrating an enlarged part of the cross-sectional view corresponding to FIG. 12 in the leading tube of FIG. 11.
Figure 16:
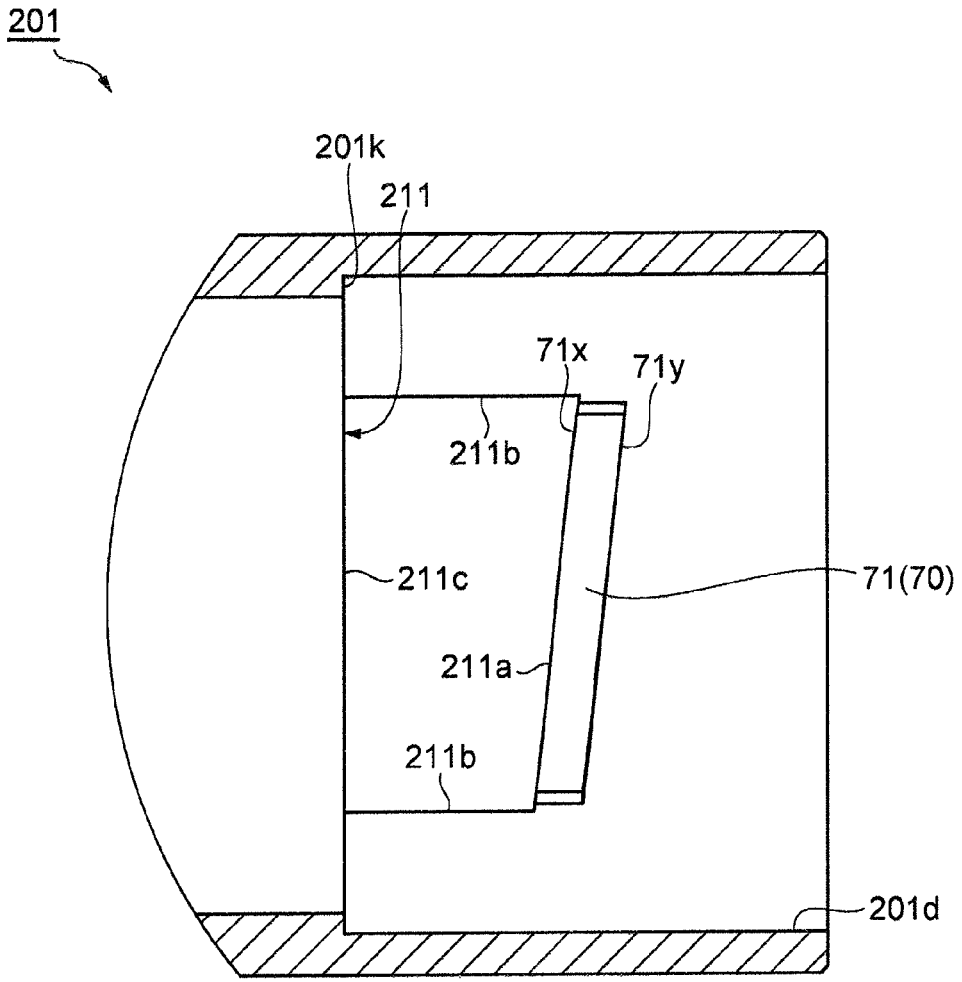
FIG. 16 is an enlarged cross-sectional view along the D-D line of FIG. 15.

FIG. 15 is an enlarged cross-sectional view illustrating an enlarged part of the cross-sectional view corresponding to FIG. 12 in the leading tube of FIG. 11, and FIG. 16 is an enlarged cross-sectional view along the D-D line of FIG. 15. As illustrated in FIGS. 11, 15 and 16, the leading tube 201 is a tubular member having a tubular shape, and as described above, has female screw 71 as a protrusion arranged in an extended manner on the inner circumferential surface 201*d*. The female screw 71 is arranged so as to be continued to the opening 211 penetrating in the radial direction through the peripheral wall of the leading tube 201.

In the side view facing the opening 211 (see FIGS. 11 and 16), the opening 211 is a tetragon, one side 211*a* constituting the trailing edge (the side on the rear side) of the opening 211 extends along the trajectory drawn by the female screw 71. In other words, the one side 211*a* is the line approximately same as the trajectory drawn by the female screw 71, and extends with an inclination angle approximately the same as that of the female screw 71. In other words, as viewed from the direction facing the opening 211, the opening 211 has, in the one side 211*a*, an inclination approximately the same as the inclination of the female screw 71 in the extending direction thereof. The opening plane 211*x* of the opening 211 is provided so as to be continued to the front end face 71*x* of the female screw 71 (so as to be in the same plane).

In the side view facing the opening 211, a pair of sides 211*b*, 211*b* constituting the sides of the opening 211 and connected to both ends of the one side 211*a* extend in the radial direction. On the inner circumferential surface of the leading tube 201, at the position corresponding to the facing side 211*c* as the front edge (the side on the front side) constituting the edges of the opening 211 and facing the one side 211*a*, a step portion 201*k* having the height equal to or higher than the height of the female screw 71 is provided in the circumferential direction. The inner diameter of the leading tube 201 is reduced as going to the front side in the axial line direction (in the direction going from the one side 211*a* to the facing side 211*c*) through the intermediary of the step portion 201*k*.

Next, an example of the production method of the leading tube 201 having such a constitution as described above is described with reference to FIG. 17.

Figure 17:
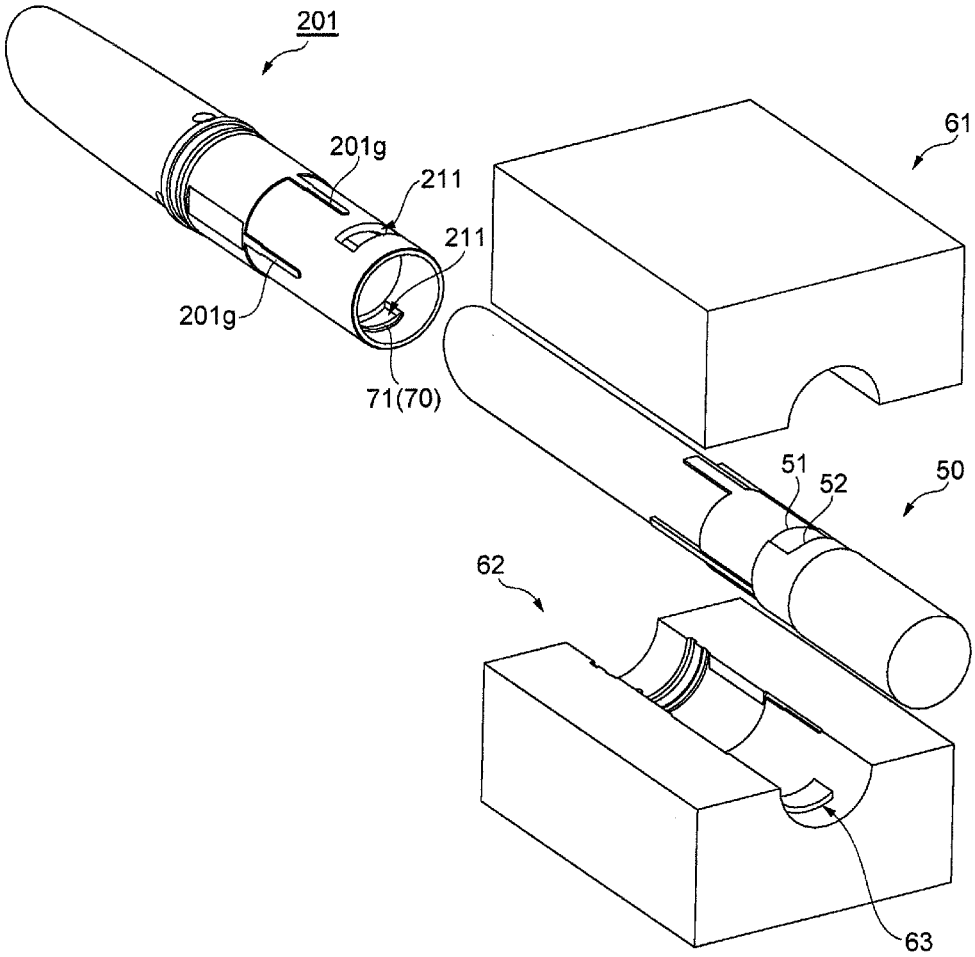
FIG. 17 is a view illustrating the production method of the leading tube of FIG. 11.

FIG. 17 is a view illustrating the production method of the leading tube of FIG. 11. In FIG. 17, for the convenience of description, the outer mold for forming the external shape of the front side taper portion of the leading tube 201 is omitted. As illustrated in FIG. 17, first, the core pin 50 having on the external surface thereof a predetermined mold shape is prepared. Additionally, as a mold having on the inner surface thereof a predetermined mold shape (outer mold for molding), a slide 61, which is an upper split mold, and a slide 62, which is a lower split mold, are prepared. The slides 61 and 62 are arranged by combining the slides 61 and 62 in such a way that the core pin 50 is surrounded in a predetermined manner, and a molten resin is injected into the gap between the core pin 50 and the slides 61 and 62. Thus, the molten resin flows into the gap, and then the resin is solidified to form the leading tube 201.

Here, the core pin 50 is formed in a cylindrical shape with step, and has a step portion 51 provided in the circumferential direction as a portion to form the step portion 201*k* of the leading tube 201. The core pin 50 is reduced in diameter on the more front side than the step portion 51 relative to the rear side. At the two positions transferred with a 180° rotation in the circumferential direction, on the outer circumferential surface of the core pin 50, the open recessed portion 52 for forming the female screw 71 and the opening 211 are formed. The open recessed portion 52 is provided in a manner connected to the step portion 51. Specifically, the open recessed portion 52 is provided on the rear side from the edge of the step portion 51 and is open to the outside in the radial direction and to the front side in the axial line direction.

The open recessed portion 52 is designed to be approximately rectangular in the view facing the step portion 51 (upward direction or downward direction as shown in the figure). The open recessed portion 52 includes the rear edge extending in the spiral direction relative to the circumferential direction and both sides extending in the axial line direction. The rear edge of the open recessed portion 52 extends along the trajectory drawn by the female screw 71 as viewed from the direction facing the open recessed portion 52. The rear wall surface of the open recessed portion 52 corresponds to the rear end face 71*y* of the female screw 71 (see FIG. 15). The depth of the open recessed portion 52 (the dimension in the radial direction) is designed to be smaller than the height of the step portion 51; in other words, the height of the step portion 51 is designed to be equal to or larger than the depth of the open recessed portion 52.

On the other hand, the slides 61 and 62 are designed to be the same in shape as each other, and each have a convex portion 63 for forming the opening 211. The convex portion 63 is approximately rectangular, and is designed to have a shape protruding inward in the radial; direction. Specifically, the convex portion 63 includes the front edge extending in the circumferential direction as corresponding to the facing side 211*c* of the opening 211, the rear edge extending in the spiral direction relative to the circumferential direction as corresponding to the one side 211*a* of the rear edge of the opening 211, and both sides extending in the axial line direction as corresponding to the sides 211*b* of the opening 211. The rear edge of the convex portion 63 extends along the trajectory drawn by the female screw 71. The front end face of the convex portion 63 (the face on the inside in the radial direction) is designed to be the same curved surface as the bottom of the open recessed portion 52.

When the core pin 50 is combined with the slides 61 and 62, in the state in which the front edge of the convex portion 63 is located at the edge of the step portion 51 of the core pin 50, such a convex portion 63 is arranged in the open recessed portion 52 of the core pin 50, and the front end face of the convex portion 63 abuts to the bottom of the open recessed portion 52. Thus, in the open recessed portion 52, a predetermined space corresponding to the shape of the female screw 71 is demarcated between the open recessed portion 52 and the convex portion 63.

After the completion of the molding (in other words, the molten resin is filled and solidified in the predetermined space to form the female screw), the slide 61 is opened upward in such a way that the convex portion 63 of the slide 61 is pulled outward in the radial direction, and at the same time, the slide 62 is opened downward in such a way that the convex portion 63 of the slide 62 is pulled outside in the radial direction. The core pin 50 is slid straight backward in the axial line direction and pulled out from in the leading tube 201. Thus, the molding of the leading tube 201 is completed.

As described above, in the present embodiment, by taking advantage of the opening 211 of the leading tube 201, the use of one core pin 50 allows the female screw 71 of the first screw part 70 to be molded without rotating and pulling out the core pin 50 and without forcible removal of the core pin 50. Accordingly, the production of the applying material extruding container 200 can be facilitated.

In the present embodiment, in the side view facing the opening 211, the pair of the sides 211*b* extend in the axial line direction. Thus, for example when the female screw 71 having an undercut shape is molded, the release from the mold can be easily performed without causing forcible removal.

In the present embodiment, on the inner circumferential surface of the leading tube 201, at the position corresponding to the facing side 211*c*, the step portion 201*k* having a height equal to or higher than the height of the female screw 71 is provided in the circumferential direction. The inner diameter of the leading tube 201 is reduced forward through the intermediary of the step portion 201*k*. In this case, for example, when the female screw 71 having an undercut shape is molded, easy release without forcible removal is made further feasible.

In the present embodiment, the openings 211 are formed at two positions transferred with a 180° rotation in the circumferential direction in the leading tube 201. Thus, when the leading tube 201 is molded, by using the slides 61 and 62, a way of opening in upward and downward, two directions, namely, the so-called two-way split can be implemented.

In the present embodiment, the pair of the sides 211*b* of the opening 211 may extend in a manner expanding toward outside on going toward the front side. Even in this case, for example, when the female screw 71 having an undercut shape is formed, the release from the mold can be easily performed without causing forcible removal. Incidentally, when the female screw 71 is formed in such a way that the core pin 50 is pulled out forward, the front inner surface of the opening 211 may be arranged so as to be connected to the rear end face of the female screw 71.

In the present embodiment, the rear end face 71*y* (see FIG. 16) of the female screw 71 may also be inclined in such a way that in the one end side (when the container main body 202 and the control tube 203 are relatively rotated in one direction, a side engaging with the male screw 72 first) of the female screw 71 in the circumferential direction, the width in the axial line direction of the female screw 71 becomes smaller on going to the one end side. In other words, in the rear end face 71*y* of the female screw 71, one end side in the circumferential direction may have a taper shape in such a way the one end side in the circumferential direction tapers off. Thus, for example, the female screw 71 and the male screw 72 can be easily screwed.

As the applying material extruding container, for example, as described in Japanese Unexamined Patent Application Publication No. 2006-305318, there has been hitherto known an applying material extruding container including a main body, a leading tube mounted relatively rotatably to the tip side of the main body, and a pipe member housed in the leading tube and at the same time, filled in the inside thereof with a rod-like body (applying material) in a slidable manner. In such an applying material extruding container, when the leading tube and the main body are relatively rotated, the pipe member is made to move forward together with the rod-like body relative to the leading tube by the screwing action of the first screw part (screw part), the rod-like body is made to move forward relative to the leading tube and the pipe member by the screwing action of the second screw part (screw part), and consequently, the rod-like body is allowed to be in a use state.

However, in the above-described conventional applying material extruding container, usually when the female screw of the screw part is injection-molded, the core pin (core) is required to be pulled out by rotation after the molding, and hence the molding time tends to be long and at the same time, the mold may be required to be complicated. In this regard, it is also possible to injection mold the female screw by confronting a pair of core pins with each other (for example, see Japanese Patent Laid-Open No. 2009-39173). However, in this case, although the core pins are not required to be pulled out by rotation, the tip shapes of the core pins may be complicated.

An aspect of the present invention has been achieved in view of the above-described circumstances, and an object of the present invention is to provide applying material extruding container capable of realizing the facilitation of the production thereof. In order to solve the above-described problems, the applying material extruding container according to an aspect of the present invention includes a movable body and a screw part in a container including a front section of the container and a rear section of the container, the screwing action of the screw part is made to operate by relatively rotating the front section of the container and the rear section of the container to allow the movable body to move forward; wherein the applying material extruding container includes a tubular member having a tubular shape, the screw part includes a female screw as an ridge spirally extending on the inner circumferential surface of the tubular member, an opening penetrating through the peripheral wall of the tubular member is formed on the peripheral wall, the female screw is arranged so as to be continued to the opening, and one side constituting the sides of the opening extends along the trajectory drawn by the female screw in the side view facing the opening.

In this applying material extruding container, by taking advantage of the opening, the use of a core pin allows the female screw of the screw part to be molded without rotating and pulling out the core pin by rotation. In other words, for example, when the molds and the core pin are assembled with each other, the convex portions on the inner sides in the radial direction in the molds and the core pin allow predetermined spaces corresponding to the female screw to be demarcated. After the completion of the molding (in other words, the molten resin is filled and solidified in the predetermined space to form the female screw), the convex portions of the molds can be disassembled in such a way that the convex portions of the molds are pulled out, and at the same time, the core pin can be slid and pulled out straight in the axial line direction. Accordingly, the production of the applying material extruding container can be facilitated.

In the applying material extruding container according to an aspect of the present invention, the opening is sometimes arranged in such a way that the inner surface on the rear side of the opening is continued to the front end face of the female screw or the inner surface on the front side of the opening is continued to the rear end face of the female screw.

In the applying material extruding container according to an aspect of the present invention, in the side view facing the opening, the one pair of the sides constituting the sides of the opening and connected to both ends of the one side may extend in the axial line direction. In this case, for example, when a female screw having an undercut shape is molded, the release from the mold can be easily performed without causing forcible removal.

In the applying material extruding container according to an aspect of the present invention, on the inner circumferential surface of the tubular member, at a position corresponding to the facing side constituting the side of the opening and facing the one side, a step portion having a height equal to or higher than the height of the female screw is provided in the circumferential direction, and the inner diameter of the tubular member may be reduced in the direction heading from the one side to the facing side through the intermediary of the step portion. In this case, for example, when a female screw having an undercut shape is molded, easy release without forcible removal is made further feasible.

In the applying material extruding container according to an aspect of the present invention, the opening may be formed at the two positions transferred with a 180° rotation in the circumferential direction in the tubular member. In this case, for example, it is possible to cope with the so-called two way split (the use as the mold of a split mold to open in upward and downward, two directions, as the mold).

According to one aspect of the present invention, it is possible to provide an applying material extruding container capable of facilitating the production.

Next, an applying material extruding container according to another embodiment of the present invention is described with reference to FIGS. 18 to 21. In the following description, the same descriptions as for the applying material extruding container 200 are omitted, and descriptions different from the descriptions for the applying material extruding container 200 are mainly presented.

Figure 18:
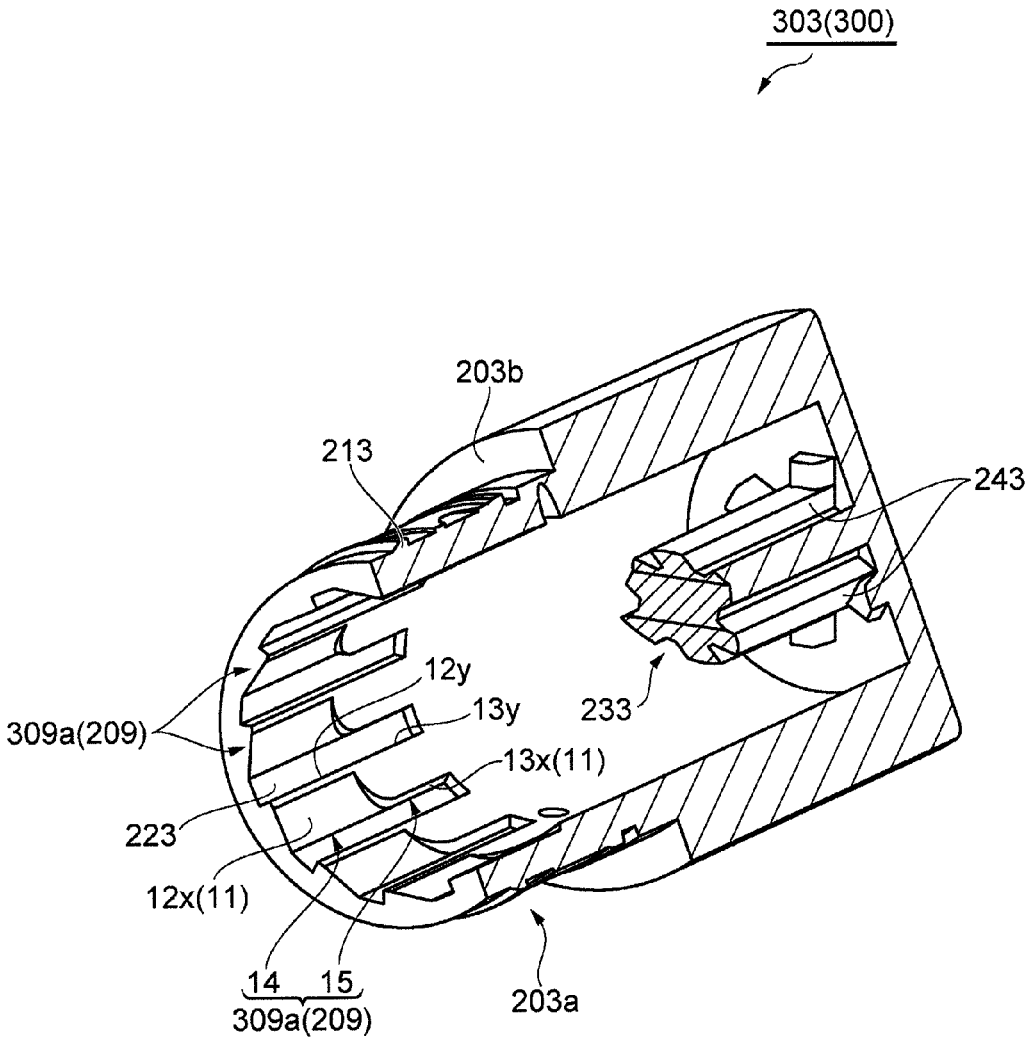
FIG. 18 is a cross-sectional oblique perspective view of the control tube of the applying material extruding container according to another embodiment.
Figure 19:
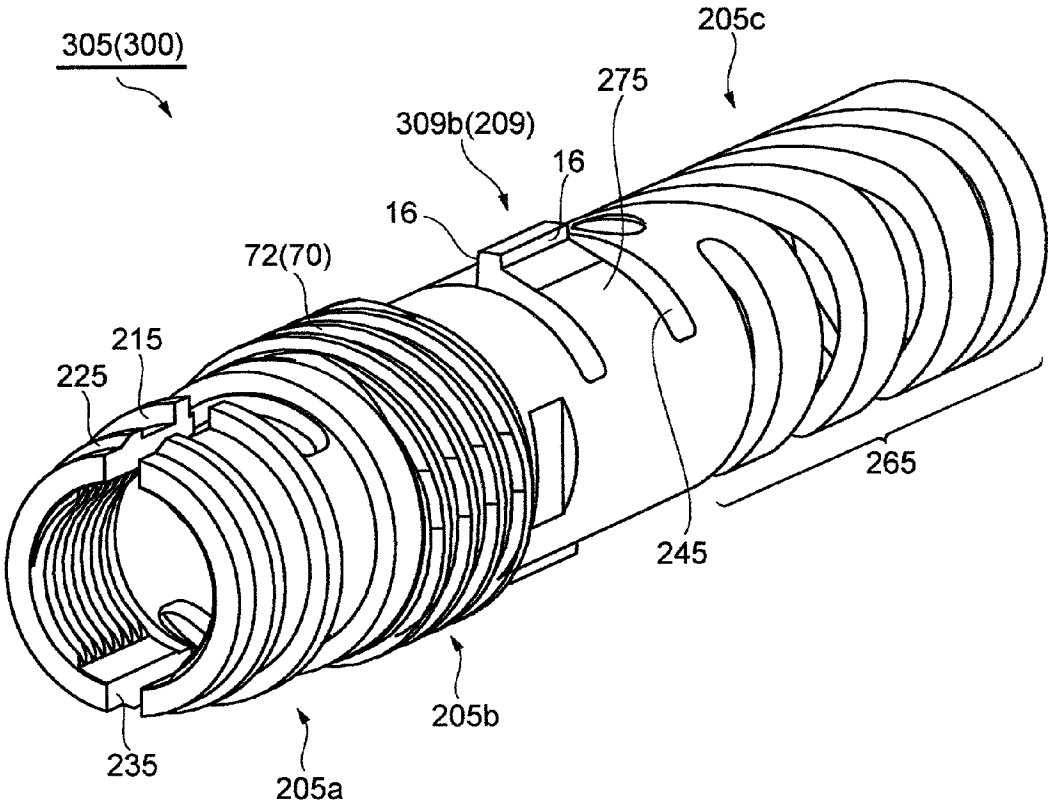
FIG. 19 is an oblique perspective view illustrating the moving screw tube of the applying material extruding container according to another embodiment.
Figure 21:
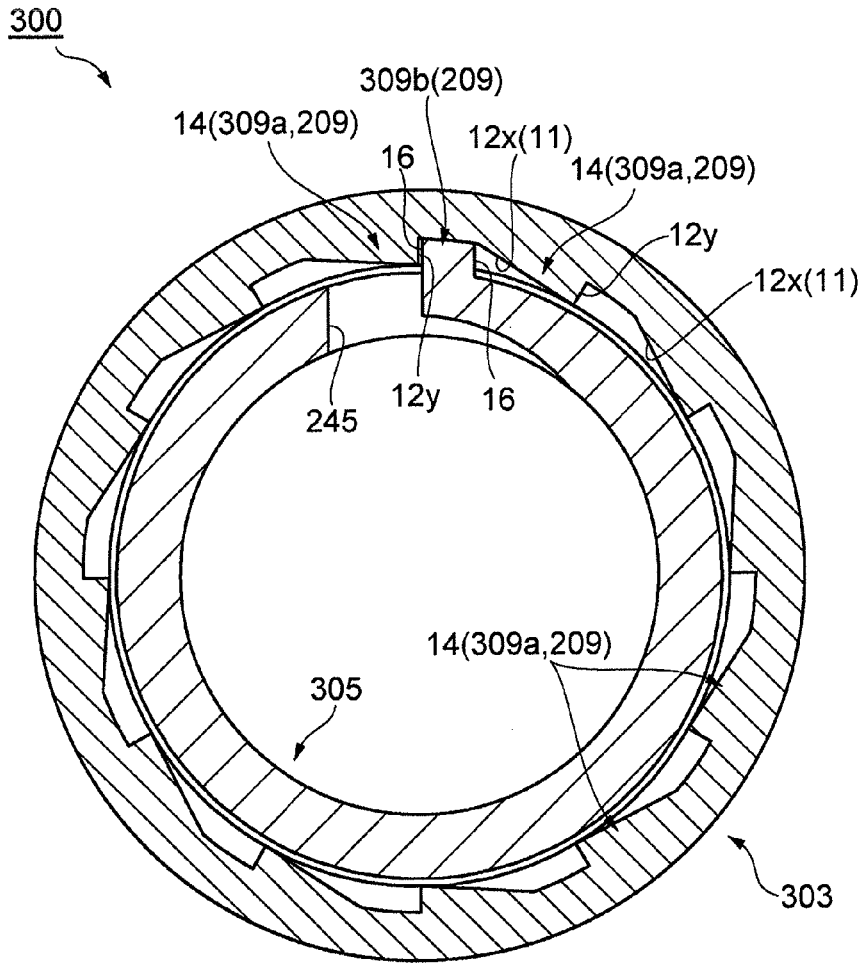
FIG. 21 is another transverse cross-sectional view illustrating the ratchet mechanism of the applying material extruding container according to another embodiment.

FIG. 18 is a cross-sectional oblique perspective view of the control tube of the applying material extruding container according to the another embodiment, FIG. 19 is an oblique perspective view illustrating the moving screw tube of the applying material extruding container according to the another embodiment, and FIG. 21 is another transverse cross-sectional view illustrating the ratchet mechanism of the applying material extruding container according to another embodiment. As illustrated in FIG. 18, the applying material extruding container 300 according to another embodiment is provided with a control tube 303 in place of the control tube 203. As illustrated in FIG. 19, the applying material extruding container 300 is provided with a moving screw tube 305 in place of the moving screw tube 205.

As illustrated in FIG. 18, the control tube 303 has one group of two or more protrusions 309*a* as a first group of ratchet teeth constituting one counterpart of the ratchet mechanism 209 allowing the relative rotation of the moving screw tube 305 and the control tube 303 to be only in one direction. The one group of protrusions 309*a* are arranged so as to protrude inward in the radial direction, at twelve equally spaced positions in the circumferential direction on the inner circumferential surface 223 of the front end tube portion 203*a*. The one group of protrusions 309*a* includes an abutting surface 11 which abut to the below-described other group of protrusions 309*b* when the container main body 202 and the control tube 303 are relatively rotated in one direction. In the one group of protrusions 309*a*, a side surface 12*x* as the front side portion of the abutting surface 11 is more inclined in the circumferential direction than the side surface 13*x* as the rear side portion of the abutting surface 11. In other words, the degree of the inclination of the side surface 12*x* in the circumferential direction is larger than the degree of the inclination of the side surface 13*x* in the circumferential direction.

Specifically, the front section 14 from the rear side to the front end of the central portion in the axial line direction in the one group of protrusions 309*a* has a mound-shaped cross section. In front section 14, the side surface 12*x* on one side (the side abutting to the other group of protrusions 309*b* when the container main body 202 and the control tube 303 are relatively rotated in one direction) in the circumferential direction is inclined relative to the tangent plane of the inner circumferential surface 223 so as to have a mound-shaped form; and at the same time, the side surface 12*y* on the other side (the side abutting to the other group of protrusions 309*b* when the container main body 202 and the control tube 303 are relatively rotated in the other direction) in the circumferential direction is constituted so as to be approximately perpendicular to the tangent plane of the inner circumferential surface 223. The rear section 15 from the rear side of to the rear end of the central portion in the central portion in the axial line direction in the one group of protrusions 309*a* has a rectangular cross section as viewed in the axial line direction. In the rear section 15, a side surface 13*x* on the one side and a side surface 13*y* on the other side in the circumferential direction are constituted so as to be approximately perpendicular to the tangent plane of the inner circumferential surface 223.

As illustrated in FIG. 19, the moving screw tube 305 has the other group of protrusions 309*b* as a second group of ratchet teeth constituting the other counterpart of the ratchet mechanism 209. The notch 245 allows the other group of protrusions 309*b* to have elasticity in the radial direction. The other group of protrusions 309*b* are designed to have a rectangular cross section as viewed in the axial line direction. Specifically, the side surfaces 16 on one side and the other side in the circumferential direction in the other group of protrusions 309*b* are constituted so as to be approximately perpendicular to the tangent plane of the outer circumferential surface 275.

Figure 20:
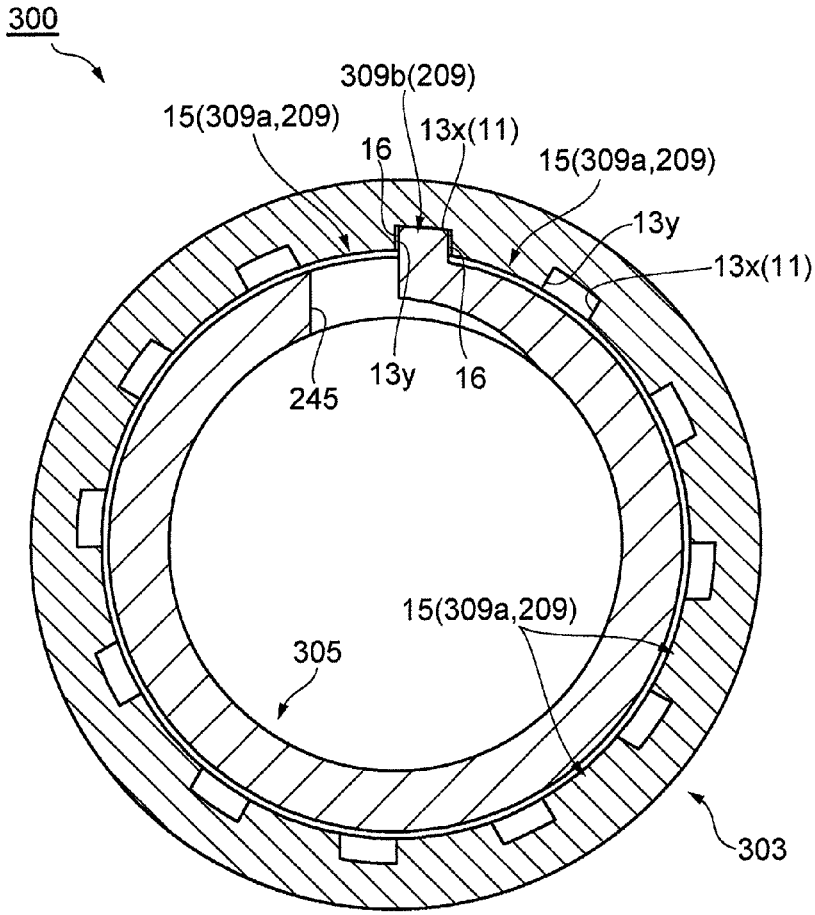
FIG. 20 is a transverse cross-sectional view illustrating the ratchet mechanism of the applying material extruding container according to another embodiment.

In such applying material extruding container 300, when the control tube 303 and the container main body 202 are relatively rotated in one direction, as illustrated in FIG. 20, the side surface 16 of the other group of protrusions 309*b* of the moving screw tube 305 abuts to the side surface 13*x* of the rear section 15 in the one group of protrusions 309*a* of the control tube 303 to be latched in the rotation direction (to be firmly engaged). Thus, the control tube 303 and the moving screw tube 305 are synchronously rotated, the moving screw tube 305 and the leading tube 201 are relatively rotated, the screwing action of the first screw part 70 operates, and the moving screw tube 305 is made to move forward relative to the leading tube 201 (and the control tube 303).

When the relative rotation in one direction is continued, as illustrated in FIG. 21, the side surface 16 of the other group of protrusions 309*b* is made to abut to the side surface 12*x* of the front section 14 in the one group of protrusions 309*a*, these groups of protrusions are engaged in the rotation direction with each other to allow the control tube 303 and the moving screw tube 305 to be synchronously rotated, and the screwing action of the first screw part 70 allows the moving screw tube 305 to further move forward. Subsequently, the forward movement of the moving screw tube 305 is stopped, and the screwing action of the first screw part 70 is stopped, and the moving screw tube 305 reaches the forward limit.

When the relative rotation in the one direction is further continued in this state, a rotational force larger than before the stopping is exerted on the control tube 303 and the moving screw tube 305, the other group of protrusions 309*b* overleap the side surface 12*x* of the one group of protrusions 309*a* in a manner running up and sliding, and the control tube 303 and the moving screw tube 305 are made to undergo relative rotation (idle rotation).

On the other hand, the container main body 202 and the control tube 303 are relatively rotated in the other direction, the side surface 16 of the other group of protrusions 309*b* abuts to the side surface 12*y* or the side surface 13*y* of the one group of protrusions 309*a* to be latched in the rotation direction, and the control tube 303 and the moving screw tube 305 are synchronously rotated. Thus, the moving screw tube 305 and the leading tube 201 are relatively rotated, the screwing action of the first screw part 70 operates, and the moving screw tube 305 is made to move backward relative to the leading tube 201 (and the control tube 303).

As described above, in the applying material extruding container 300 of the present embodiment, when the container main body 202 and the control tube 303 are relatively rotated in one direction, the one group of protrusions 309*a* and the other group of protrusions 309*b* abut in the abutting surface 11 to each other through the intermediary of the side surface 13*x* small in the inclination degree in the rotation direction. Accordingly, one group of protrusions 309*a* and the other group of protrusions 309*b* are latched with each other to synchronously rotate the moving screw tube 305 and the control tube 303, and the moving screw tube 305 is made movable forward. When the relative rotation is further performed in the one direction, the one group of protrusions 309*a* and the other group of protrusions 309*b* abut to each other on the abutting surface 11, through the intermediary of the side surface 12*x* of the front side portion small in the inclination degree in the circumferential direction. Accordingly, the other group of protrusions 309*b* are made to slide in a manner running up on the side surface 12*x*, the moving screw tube 305 and the control tube 303 can be relatively rotated, and for example, the breakage of the first screw part 70 can be prevented. As described above, according to the present embodiment, the synchronous rotation and the relative rotation of the moving screw tube 305 and the control tube 303 can be certainly controlled certainly.

As a recent applying material extruding container, an applying material extruding container has been developed in which a movable screw having a screw part is provided in the container including the front section of the container and the rear section of the container; when the front section of the container and the rear section of the container are relatively rotated in one direction, a moving screw tube is made to move forward relative to the rear section of the container by the screwing action of the screw part and then stopped. In such an applying material extruding container, for example, in order to certainly control the movement of the moving screw tube or prevent the breakage of the screw part, it is desired to certainly control the synchronous rotation and the relative rotation (idle rotation) of the moving screw tube and the rear section of the container when the moving screw tube and the rear section of the container are relatively rotated in one direction. In other words, it is demanded to provide an applying material extruding container capable of certainly controlling the synchronous rotation and the relative rotation of the moving screw tube and the rear section of the container.

Accordingly, the applying material extruding container is an applying material extruding container being provided with a moving screw tube having a screw part in a container including a front section of the container and a rear section of the container, and allowing the moving screw tube to move forward and then strop, by the screwing action of the screw part, relative to the rear section of the container when the front section of the container and the rear section of the container are relatively rotated in one direction, wherein a ratchet mechanism allowing relative rotation of the moving screw tube and the rear section of the container only in one direction is provided; the moving screw tube has a first group of ratchet teeth constituting one counterpart of the ratchet mechanism; the rear section of the container has a second group of ratchet teeth constituting the other counterpart of the ratchet mechanism; the second group of ratchet teeth includes an abutting surface which abuts in the circumferential direction to the first group of ratchet teeth when the front section of the container and the rear section of the container are relatively rotated in one direction; the front side portion in the abutting surface is more inclined in the circumferential direction than the rear side portion in the abutting surface.

In this applying material extruding container, when the front section of the container and the rear section of the container are relatively rotated in one direction, first the first group of ratchet teeth and the second group of ratchet teeth abut to each other in the rear side portion on the abutting surface, small in the inclination degree in the circumferential direction, and hence by latching these groups of ratchet teeth, the moving screw tube and the rear section of the container can be synchronously rotated. Consequently, the moving screw tube can be moved forward. When the relative rotation in the one direction is further performed, the first group of ratchet teeth and the second group of ratchet teeth are engaged with each other in the front side portion on the abutting surface, small in the inclination degree in the circumferential direction, and hence the second group of ratchet teeth can be slid in a manner running up the first group of ratchet teeth. Accordingly, the moving screw tube and the rear section of the container can be relatively rotated. Therefore, according to the applying material extruding container, the synchronous rotation and the relative rotation of the moving screw tube and the rear section of the container can be certainly controlled.

The rear side portion of the second group of ratchet teeth as viewed in the axial line direction has a rectangular cross section, and the front side portion of the second group of ratchet teeth as viewed in the axial line direction may have a mound-shaped cross section in which the side surface on one side in the circumferential direction is inclined relative to the tangent plane of the inner circumferential surface, and the side surface on the other side in the circumferential direction is approximately perpendicular to the tangent plane. The first group of ratchet teeth have elasticity in the radial direction, and may have a rectangular cross section as viewed in the axial line direction. In these cases, the advantageous effect to certainly control the synchronous rotation and the relative rotation of the moving screw tube and the rear section of the container is suitably achieved.

The preferred embodiments of the present invention are described above; however the present invention is not limited to the above-described embodiments, and may be modified or applied to other cases within the scope not changing the gist described in the individual claims.

For example, the present invention can be applied as a matter of course to applying material extruding containers using, as the applying material M, liquid applying materials such as lip gloss, lip stick, eye color, eye liner, beauty liquid, lotion, nail enamel, nail care solution, nail remover, mascara, anti-aging, hair color, hair cosmetic, oral care, massage oil, keratin softener, foundation, concealer, skin cream, inks for writing implements such as marking pens, liquid medicines, and liquid applying materials including slurry.

In the above-described embodiments, when the container main body 202 and the control tube 203 are relatively rotated in one direction, by the cooperation of the screwing actions of the first and second screw parts 70 and 80, the pipe member 208 may be made to move forward together with the applying material M relative to the leading tube 201; similarly, when the container main body 202 and the control tube 203 are relatively rotated in the other direction, by the cooperation of the screwing actions of the first and second screw parts 70 and 80, the pipe member 208 may be made to move backward together with the applying material M relative to the leading tube 201. In the above-described embodiments, the first and second screw parts 70 and 80 are provided; however, only one screw part is provided, and by the one screw part, the applying material M may be extruded or drawn back.

In the foregoing description, the "lifting of the screwing action" means that the engagement between the threads of the male screw and the female screw is disengaged, and the screwing action is made not to operate; the "stopping of the screwing action" means that the threads of the male screw and the female screw abut to each other in the state of being engaged with each other, and thus the screwing action is made not to operate. The "restoration of screwing" means the stage in which the male screw gets back so as to abut to the side surface of the thread of the female screw.

"Approximately the same position" in the front end of the pipe member 208 and the front end of the leading tube 201 includes approximately the same position in addition to perfectly the same position, and involves errors in design, production and assembling. For example, the front end of the pipe member 208 may be located to a somewhat extent on the front side or rear side relative to the front end of the leading tube 201. Similarly, "approximately the same line or inclination angle" includes approximately the same line or inclination angle in addition to perfectly the same line or inclination angle, and involves the errors in design, production and assembling. At least any one of the one side 211*a*, the sides 211*b* and the facing side 211*c* may be constituted by also including a curve or a free-form curve in addition to a straight line.

The above-described male screw and female screw may each include, in addition to threads and screw grooves, structural elements functioning similarly to the threads and screw grooves, such as a group of intermittently arranged protrusions or a group of spirally and intermittently arranged protrusions. The cross-sectional shape of the applying material M is made to be the same as the cross sectional inner diameter shape of the tube hole 201*s* of the leading tube 201, or the pipe hole 208*s* of the pipe member 208; however, in addition to circular cross sections, various noncircular cross-sectional shapes such as an elliptical shape, a racetrack-type shape and a polygon with rounded apexes and a drop-type shape can also be selected. The present invention can also be grasped as production method for producing the applying material extruding container 200.

What is claimed is:

1. An applying material extruding container, comprising:

a screw part, a leading tube forming a tubular shape and having an opening at a tip thereof, and a pipe member inserted into the leading tube so as to be slidable in an axial line direction of the leading tube relative to the leading tube, wherein in an initial state, a front end of the pipe member is located at a position displaced backward by a predetermined distance from a front end of the leading tube, wherein a pipe hole of the pipe member and a tube hole of the leading tube are adapted to be filled with an applying material;

wherein an entire inner surface of a region of the tube hole that is adapted to contact the applying material and slidably engages the pipe member extends straight in the axial line direction so as to be devoid of any step portions;

when a front section of the container and a rear section of the container are relatively rotated in one direction, a screwing action of the screw part is adapted to move the pipe member forward, together with the applying material, relative to the leading tube, and when further relatively rotated in the one direction, the screwing action of the screw part is adapted to move the applying material forward, relative to the leading tube and the pipe member; and when the front section of the container and the rear section of the container are relatively rotated in another direction, the screwing action of the screw part is adapted to move the pipe member backward, together with the applying material, relative to the leading tube.

2. The applying material extruding container according to claim 1, wherein the front end of the pipe member is located in forward limit thereof at approximately the same position as the front end of the leading tube.

3. The applying material extruding container according to claim 2, wherein the screw part comprises a first screw part and a second screw part; and when the front section of the container and the rear section of the container are relatively rotated in the one direction, by the screwing action of the first screw part or the screwing action of the first and second screw parts, the pipe member is adapted to move forward, together with the applying material, relative to the leading tube, and when further relatively rotated in the one direction, the screwing action of the second screw part is adapted to move the applying material forward relative to the leading tube and the pipe member.

4. The applying material extruding container according to claim 1, wherein the screw part comprises a first screw part and a second screw part; and when the front section of the container and the rear section of the container are relatively rotated in the one direction, by the screwing action of the first screw part or the screwing action of the first and second screw parts, the pipe member is adapted to move forward, together with the applying material, relative to the leading tube, and when further relatively rotated in the one direction, the screwing action of the second screw part is adapted to move the applying material forward relative to the leading tube and the pipe member.

* * * * *